US007740199B2

(12) United States Patent
Aikoh et al.

(10) Patent No.: US 7,740,199 B2
(45) Date of Patent: Jun. 22, 2010

(54) METALLIC FILAMENT END RETAINING CLIP AND TAKE-UP REEL FOR METALLIC FILAMENT

(75) Inventors: Takayuki Aikoh, Ono (JP); Hiroyuki Kawazoe, Kobe (JP)

(73) Assignee: Tokusen Kogyo Co., Ltd., Ono, Hyogo (JP)

( * ) Notice: Subject to any disclaimer, the term of this patent is extended or adjusted under 35 U.S.C. 154(b) by 0 days.

(21) Appl. No.: 12/065,206

(22) PCT Filed: Aug. 30, 2006

(86) PCT No.: PCT/JP2006/317119

§ 371 (c)(1),
(2), (4) Date: Sep. 16, 2008

(87) PCT Pub. No.: WO2007/026770

PCT Pub. Date: Mar. 8, 2007

(65) Prior Publication Data

US 2009/0134259 A1 May 28, 2009

(30) Foreign Application Priority Data

Aug. 30, 2005 (JP) ..... 2005-249455
Sep. 29, 2005 (JP) ..... 2005-284232

(51) Int. Cl.
*B65H 75/28* (2006.01)

(52) U.S. Cl. ..... 242/580; 242/125.2

(58) Field of Classification Search ..... 242/476.1, 242/476.6, 579, 580, 586, 586.6, 614, 125, 242/125.1, 125.2
See application file for complete search history.

(56) References Cited

U.S. PATENT DOCUMENTS

| | | | | |
|---|---|---|---|---|
| 5,485,968 | A * | 1/1996 | Fujioka | 242/125.2 |
| 5,549,257 | A * | 8/1996 | Sanda et al. | 242/580 |
| 5,586,733 | A * | 12/1996 | Miura et al. | 242/125.2 |
| 5,603,469 | A * | 2/1997 | Stocchi | 242/580 |
| 5,901,920 | A | 5/1999 | Takahashi et al. | |
| 5,931,408 | A * | 8/1999 | Ishii et al. | 242/580 |
| 6,425,549 | B1 * | 7/2002 | Bae et al. | 242/580 |
| 6,460,797 | B1 * | 10/2002 | Takahashi et al. | 242/470 |

FOREIGN PATENT DOCUMENTS

| | | |
|---|---|---|
| CN | 1114631 A1 | 1/1996 |
| JP | S58-184467 U | 12/1983 |
| JP | H6-1569 Y | 1/1994 |
| JP | 2901935 | 3/1999 |

* cited by examiner

*Primary Examiner*—John Q Nguyen
*Assistant Examiner*—William E Dondero
(74) *Attorney, Agent, or Firm*—Browdy and Neimark, PLLC.

(57) ABSTRACT

To make it possible to replace a metallic filament end retaining clip in a take-up reel for metallic filament, a clip (10) has, for example, a clip portion (11) having an essentially W shape, and attachment arm portions (12) and coiled portions (14) on both sides thereof. The upper portion of the clip portion (11) and the attachment arm portions (12) are fitted into the space between a flange outer periphery portion (4), and the end part of a metallic filament W is retained through elastic force. Alternatively, a clip mounting portion (107) and a clip tip retaining portion (109) are formed in a flange (101), into which a clip (110) is mounted in a detachable state, the clip (110) having, for example, essentially inverse U-shaped positioning attachment portions (112) formed on both sides of an essentially U-shaped clip portion (111).

2 Claims, 18 Drawing Sheets

(a)

(b)

(a)

(b)

(a)

(b)

(a)

(b)

(a)

(b)

METALLIC FILAMENT END RETAINING CLIP AND TAKE-UP REEL FOR METALLIC FILAMENT

TECHNICAL FIELD

The present invention relates to a removable metallic filament end retaining clip that retains the end part of a metallic filament, such as steel wire, steel cord, wire rope, electrical wire, and the like, that has been taken up on a take-up reel for metallic filament, and also relates to a take-up reel for metallic filament provided with such a clip.

BACKGROUND ART

The following conventional technique is known as an example of a technique for retaining an end part of a metallic filament that has been fully taken up onto a take-up reel for metallic filament provided with a flange on both sides of the winding drum: a passage hole through which the end part of the metallic filament is passed is provided in a flange; a retaining member such as a clip made of steel wire is provided on the flange outer surface in the vicinity of the passage hole; and the end part of the metallic filament that has been passed through the passage hole is sandwiched between the retaining member and the flange outer surface (for example, see Patent Document 1).

In the case of, for example, a pressed reel, where the flange is made of a metallic plate and has a hollow ring-shaped outer periphery portion that curls outward in the axial direction of the reel across the entire circumference of the outer edge, the stated technique anchors the retaining member to the flange, after the retaining member has been mounted in the space between the curled flange outer periphery portion and the flange outer surface, by pressing down the flange outer periphery portion across the entire circumference thereof, thereby reducing the stated space, or crimping several areas using a puncher or the like.

[Patent Document 1] H6-1569 Y1

DISCLOSURE OF INVENTION

Problem to be Solved by the Invention

According to the conventional technique for retaining the end part of a metallic filament taken up onto a take-up reel for metallic filament, the retaining member such as a clip is anchored, after being mounted in the space between the flange outer periphery portion and the flange outer surface, by pressing down the flange outer periphery portion across the entire circumference thereof, thereby reducing the stated space, or crimping several areas using a puncher or the like. A retaining member in such a conventional reel has a configuration whereby it cannot securely retain the end part of a metallic filament if it are not anchored, and thus has been required to be anchored. For this reason, the retaining member cannot be replaced with ease, meaning that the reel itself must be discarded if the retaining member has been damaged, which shortens the lifespan of the reel.

Having been conceived in light of such a problem, it is an object of the present invention to make it possible to replace a metallic filament end retaining clip mounted in a take-up reel for metallic filament, thereby extending the lifespan of the reel.

Means for Solving Problem

The present invention provides a metallic filament end retaining clip and a take-up reel for metallic filament capable of solving the abovementioned problem.

In other words, a metallic filament end retaining clip according to the present invention is a metallic filament end retaining clip mountable in a take-up reel for metallic filament provided with a flange made of a metallic plate on both sides of a winding drum that has a hollow ring-shaped flange outer periphery portion curling outward in the axial direction of the reel across the entire circumference of an outer edge, forming a space between the flange outer periphery portion and a flange outer surface, the metallic filament end retaining clip being mountable in a removable state in the space between the flange outer periphery portion and the flange outer surface, wherein attachment arm portions are formed on both sides of a clip portion, extending from both upper ends of the clip portion, the clip portion being formed of wire having elasticity, coiled portions are formed in the upper portion of the clip portion, the attachment arm portions are deformed and held within the interior of the flange outer periphery portion by fitting the attachment arm portions into the interior of the flange outer periphery portion via the space between the flange outer periphery portion and the flange outer surface, and the clip portion is pressed down upon the flange outer surface due to the elastic force caused by the deformation of the clip portion and the elastic force of the coiled portions, and thereby the end part of a metallic filament is retained between the clip portion and the flange outer surface.

With such a metallic filament end retaining clip, the attachment arm portions are deformed and held within the interior of the flange outer periphery portion by fitting the attachment arm portions into the interior of the flange outer periphery portion via the space between the flange outer periphery portion and the flange outer surface, and the clip portion is pressed down upon the flange outer surface due to the elastic force caused by the deformation of the clip portion and the elastic force of the coiled portions, thereby making it possible to retain the end part of a metallic filament between the clip portion and the flange outer surface.

The space of the flange outer periphery portion maintains its size even after the clip has been mounted, and therefore the metallic filament end retaining clip can be removed from this space using a procedure opposite to that used during mounting, making it possible to easily remove and replace a damaged metallic filament end retaining clip.

In particular, it is preferable for this metallic filament end retaining clip to be configured so that a clip portion, formed from an elastic wire, is bent in an essentially W shape when viewed from the front, and attachment arm portions that extend the upper ends of the W shape in an essentially horizontal direction are formed on both sides of the clip portion; guide portions for capturing the end part of a metallic filament are configured by slanting the vicinity of lower curved portions on both sides of the clip portion forward, as viewed from the side, at a first angle relative to the upper portion and middle portion of a part that forms an inverse V when the center of the clip portion is viewed from the front; the upper portion of the clip portion, excluding the guide portions of the outer wire portions of essentially V shapes on either side when viewed from the front, is, in its free state, slanted forward at a second angle relative to the guide portions when viewed from the side, the second angle being greater than the first angle, and coiled portions are formed in the vicinity of the upper ends of the outer wire portions; the attachment arm portions are, in their free states, angled forward relative to a line that connects the upper ends of the W shape of the clip portion, and the tip sides of the attachment arm portions are bent even further forward; and the top bent portions in the center of the clip portion are positioned higher than the line that connects the upper ends of the W shape of the clip portion.

With such a metallic filament end retaining clip, in its free state, prior to being mounted, the vicinity of the bottom bent portions of both sides of the clip portion are slanted forward at a first angle relative to the upper portion and the central portion of the part that is essentially an inverse V shape in the center of the clip portion, so as to form guide portions for capturing the end part of the metallic filament. The upper side of the part of the clip portion excluding the guide portions of the outer wire portions of essentially V shapes on either side of the clip portion, is, in its free state, slanted forward at a second angle relative to the guide portions, the second angle being greater than the first angle; the attachment arm portions are angled forward relative to a line that connects the upper ends of the W shape of the clip portion, and the tip sides of the attachment arm portions are bent even further forward. The space in the flange outer periphery portion is set to a minimum size that still allows for the insertion of the top bent portion in the center of the clip portion of the metallic filament end retaining clip and for the fitting of the attachment arm portions on both sides into the interior of the flange outer periphery portion. When the top bent portion in the center of the clip portion is inserted into the space between the flange outer periphery portion and the flange outer surface and the attachment arm portions on both sides are fitted into the interior of the flange outer periphery portion, the attachment arm portions undergo deformation, and the part that is essentially an inverse V shape in the center of the clip portion is pressed down upon the flange outer surface due to the elasticity resulting from the deformation. The outer wire portions that are essentially V shapes on both sides of the clip portion undergo deformation and are pressed down on the flange outer surface side, thus essentially overlapping, when viewed from the side, with the part that is essentially an inverse V shape in the center of the clip portion. The essentially inverse V-shaped part is pressed down upon the flange outer surface due to the elastic force of the outer wire portions caused by the deformation of the clip portion and the elastic force of the coiled portions. The metallic filament end retaining clip is held by the flange outer periphery portion due to the top bent portion in the center of the clip portion and the attachment arm portion pressing apart from one another within the flange outer periphery portion, and the clip portion is pressed down upon the flange outer surface due to the elastic force. Accordingly, the end part of a metallic filament can be securely retained between the clip portion and the flange outer surface.

The space of the flange outer periphery portion maintains its size even after the clip has been mounted, and therefore the metallic filament end retaining clip can be removed from this space using a procedure opposite to that used during mounting, making it possible to easily remove and replace a damaged metallic filament end retaining clip.

The retaining force (gripping force) can be adjusted by setting the relative angles at which the various portions of the clip portion slant forward.

Furthermore, a take-up reel for metallic filament according to the present invention is a take-up reel for metallic filament provided with a flange made of a metallic plate on both sides of a winding drum that has a hollow ring-shaped flange outer periphery portion curling outward in the axial direction of the reel across the entire circumference of an outer edge, forming a space between the flange outer periphery portion and the flange outer surface, the flange including a passage hole for passing the end part of a metallic filament into the flange, and a metallic filament end retaining clip being mounted in a removable state in the space between the flange outer periphery portion and the flange outer surface, wherein, in the metallic filament end retaining clip, attachment arm portions are formed on both sides of a clip portion, extending from both upper ends of the clip portion, the clip portion being formed of wire having elasticity, coiled portions are formed in the upper area of the clip portion, the attachment arm portions are deformed and held within the interior of the flange outer periphery portion by fitting the attachment arm portions into the interior of the flange outer periphery portion via the space between the flange outer periphery portion and the flange outer surface, and the clip portion is pressed down upon the flange outer surface due to the elastic force caused by the deformation of the clip portion and the elastic force of the coiled portions, and thereby the end part of a metallic filament, which has been passed through the passage hole and drawn in along the guide portions, is retained between the clip portion and the flange outer surface.

With a metallic filament end retaining clip in such a take-up reel for metallic filament, the attachment arm portions are deformed and held within the interior of the flange outer periphery portion by fitting the attachment arm portions into the interior of the flange outer periphery portion via the space between the flange outer periphery portion and the flange outer surface, and the clip portion is pressed down upon the flange outer surface due to the elastic force caused by the deformation of the clip portion and the elastic force of the coiled portions, thereby making it possible to retain the end part of a metallic filament between the clip portion and the flange outer surface.

The space of the flange outer periphery portion maintains its size even after the clip has been mounted, and therefore the metallic filament end retaining clip can be removed from this space using a procedure opposite to that used during mounting, making it possible to easily remove and replace a damaged metallic filament end retaining clip.

In particular, it is preferable for the take-up reel for metallic filament to be configured so that the metallic filament end retaining clip is configured so that a clip portion, formed from an elastic wire, is bent in an essentially W shape when viewed from the front, and attachment arm portions that extend the upper ends of the W shape in an essentially horizontal direction are formed on both sides of the clip portion; guide portions are configured by slanting the vicinity of lower curved portions on both sides of the clip portion forward at a first angle relative to the top portion and middle portion of a part that forms an inverse V when the center of the clip portion is viewed from the front; the upper portion of the clip portion, excluding the guide portions, of the outer wire portions of essentially V shapes on either side when viewed from the front, is, in its free state, slanted forward at a second angle relative to the guide portions when viewed from the side, the second angle being greater than the first angle, and coiled portions are formed in the vicinity of the upper ends of the outer wire portions; the attachment arm portions are, in their free states, angled forward relative to a line that connects the upper ends of the W shape of the clip portion, and the tip sides of the attachment arm portions are bent even further forward; and the top bent portions in the center of the clip portion are positioned higher than the line that connects the upper ends of the W shape of the clip portion, and the top bent portion in the center of the clip portion of the metallic filament end retaining clip can be inserted into the space between the flange outer periphery portion and the flange outer surface and the attachment arm portions on both sides can be fitted into the space in a detachable state, the metallic filament end retaining clip is positioned on the flange outer surface, making contact therewith, and by inserting the top bent portion in the center of the clip portion into the space between the flange outer periphery portion and the flange outer surface and fitting the attachment arm portions into the interior of the flange outer periphery portion, the part that essentially forms an inverse V shape in the center of the clip portion is pressed upon the flange outer surface due to the elastic force of the deformed and fitted attachment arm portions, and the outer wire portions that essentially form V shapes on both sides of the clip portion are deformed and pressed down on the flange outer surface side so as to essentially overlap, when viewed from the side, with the part in the center of the clip portion that is essentially inverse V-shaped, the parts that are essentially inverse V-shaped press down upon the flange outer surface due to the elastic force of the outer wire portions caused by the deformation of the clip portion and the elastic force of the coiled portions, and thereby the end part of a metallic filament that has been passed through the passage hole and drawn along the guide portions is retained between the clip portion and the flange outer surface.

With a metallic filament end retaining clip in such a take-up reel for metallic filament, in its free state, prior to being mounted, the vicinity of the bottom bent portions of both sides of the clip portion are slanted forward at a first angle relative to the upper portion and the central portion of the part that is essentially an inverse V shape in the center of the clip portion, so as to form guide portions. The upper side of the part of the clip portion excluding the guide portions of the outer wire portions of essentially V shapes on both sides of the clip portion, is, in its free state, slanted forward at a second angle relative to the guide portions, the second angle being greater than the first angle; the attachment arm portions are angled forward relative to a line that connects the upper ends of the W shape of the clip portion, and the tip sides of the attachment arm portions are bent even further forward. The space in the flange outer periphery portion is set to a minimum size that still allows for the insertion of the top bent portion in the center of the clip portion of the metallic filament end retaining clip and for the fitting of the attachment arm portions on both sides into the interior of the flange outer periphery portion. When the top bent portion in the center of the clip portion is inserted into the space between the flange outer periphery portion and the flange outer surface and the attachment arm portions on both sides are fitted into the interior of the flange outer periphery portion, the attachment arm portions undergo deformation, and the part that is essentially an inverse V shape in the center of the clip portion is pressed down upon the flange outer surface due to the elasticity resulting from the deformation. The outer wire portions that are essentially V shapes on both sides of the clip portion are pressed down on the flange outer surface side, thus essentially overlapping, when viewed from the side, with the part that is essentially an inverse V shape in the center of the clip portion, due to the resulting deformation. The essentially inverse V-shaped part is pressed down upon the flange outer surface due to the elastic force of the outer wire portions caused by the deformation of the clip portion and the elastic force of the coiled portions. The metallic filament end retaining clip is held by the flange outer periphery portion due to the top bent portion in the center of the clip portion and the attachment arm portion pressing apart from one another within the flange outer periphery portion, and the clip portion is pressed down upon the flange outer surface due to the elastic force. Accordingly, the end part of a metallic filament can be securely retained between the clip portion and the flange outer surface.

The space of the flange outer periphery portion maintains its size even after the clip has been mounted, and therefore the metallic filament end retaining clip can be removed from this space using a procedure opposite to that used during mounting, making it possible to easily remove and replace a damaged metallic filament end retaining clip.

A smaller space of the flange outer periphery portion increases the retaining force (gripping force). For this reason, it is preferable for the space to be set to the minimum size that still allows the clip to be mounted and removed. The retaining force can be adjusted by setting the relative angles at which the various portions of the clip portion slant forward.

Furthermore, a metallic filament end retaining clip according to the present invention is a metallic filament end retaining clip mountable in a detachable state via a clip mounting portion formed in a flange outer surface of a take-up reel for metallic filament provided with a flange made of a metallic plate on both sides of a winding drum, the clip mounting portion being formed through press molding in a part of the side wall of the flange that forms the flange outer surface, so as to bulge outward in the axial direction of the reel, the entire space therebehind forming an opening in the inner surface of the flange, the clip mounting portion also forming a clip mounting hole that has a slit-shaped openings at both ends in the radial direction of the flange, and therefore passes through in the radial direction of the flange, wherein positioning attachment portions are formed continuing from a clip portion formed of wire having elasticity, the positioning attachment portions are held in the clip mounting hole in a positioned state by inserting the positioning attachment portions into the clip mounting hole inside of the inner side of the clip mounting hole relative to the radial direction of the flange along the flange outer surface, the clip portion undergoes elastic deformation and is pressed down upon the flange outer surface, thereby retaining the end part of a metallic filament between the clip portion and the flange outer surface.

With such a metallic filament end retaining clip, the positioning attachment portions are held in the clip mounting hole in a positioned state by inserting the positioning attachment portions into the clip mounting hole from the inner side of the clip mounting hole relative to the radial direction along the flange outer surface. Here, the clip portion undergoes elastic deformation and is pressed down upon the flange outer surface, and thus it is possible to retain the end part of a metallic filament between the clip portion and the flange outer surface. The metallic filament end retaining clip can be removed using a procedure opposite to that used at the time of mounting, making it possible to easily remove and replace a damaged metallic filament end retaining clip. The retaining force (gripping force) can be adjusted by setting the angles at which the clip portion is bent.

Furthermore, a take-up reel for metallic filament according to the present invention is a take-up reel for metallic filament provided with a flange made of a metallic plate on both sides of a winding drum and a passage hole for passing the end part of a metallic filament into the flange, a metallic filament end retaining clip being mounted in a removable state on the flange outer surface, wherein a clip mounting portion is formed through press molding in a part of the side wall of the flange that forms the flange outer surface, so as to bulge outward in the axial direction of the reel, the entire space therebehind forming an opening in the inner surface of the flange, the clip mounting portion also forming a clip mounting hole that has a slit-shaped openings at both ends in the radial direction of the flange, and therefore passes through in the radial direction of the flange; and in the metallic filament end retaining clip, positioning attachment portions are formed continuing from a clip portion formed of wire having elasticity, the positioning attachment portions are held in the clip mounting hole in a positioned state by inserting the positioning attachment portions into the clip mounting hole inside of the inner side of the clip mounting hole relative to the radial direction of the flange along the flange outer surface, the clip portion undergoes elastic deformation and is pressed down upon the flange outer surface, thereby retaining the end part of a metallic filament between the clip portion and the flange outer surface.

With a metallic filament end retaining clip in such a take-up reel for metallic filament, the positioning attachment portions are held in the clip mounting hole in a positioned state by inserting the positioning attachment portions into the clip mounting hole from the inside of the radial direction along the flange outer surface. Here, the clip portion undergoes elastic deformation and is pressed down upon the flange outer surface, and thus it is possible to retain the end part of a metallic filament between the clip portion and the flange outer surface. The metallic filament end retaining clip can be removed using a procedure opposite to that used at the time of mounting, making it possible to easily remove and replace a damaged metallic filament end retaining clip.

Effects of the Invention

As has been clarified by the above descriptions, the present invention makes it possible to replace a metallic filament end retaining clip mounted in a take-up reel for metallic filament, thereby extending the lifespan of the reel.

BEST MODE FOR CARRYING OUT THE INVENTION

Hereinafter, embodiments of the present invention shall be described with reference to the drawings.

First Embodiment

FIGS. 1 and 2 illustrate an example of a first embodiment of the present invention. FIG. 1 is a front view (a) and a cross-sectional view (b) of the vicinity of a flange outer periphery portion in a reel for metallic filament in which a metallic filament end retaining clip has been mounted, and FIG. 2 is a plan view (a), a front view (b), and a side view (c) of the metallic filament end retaining clip.

The take-up reel for metallic filament according to this embodiment is what is known as a pressed reel, in which flanges 1, formed by press-molding steel plates and anchoring the steel plates onto both sides of a winding drum (not shown) that is itself formed from a steel plate through welding.

The flange 1 has a hollow ring-shaped flange outer periphery portion 4 that curls outward in the axial direction of the reel across the entire circumference of the outer edge of a flange outer surface 2, forming a space 3 therebetween.

Furthermore, the flange 1 is provided with a passage hole 5, in one area near the flange outer periphery portion 4, through which the end part of a metallic filament W is passed.

A metallic filament end retaining clip 10 is mounted on the flange 1, in a removable state, in the space 3 between the flange outer periphery portion 4 and the flange outer surface 2, in the vicinity of the passage hole 5.

The metallic filament end retaining clip 10 is made of steel wire, and, as illustrated in FIG. 2 (*b*), forms a clip portion 11 bent in an essentially W shape when viewed from the front, on both sides of which are formed attachment arm portions 12 and 12 that extend the upper ends of the W shape in an essentially horizontal direction.

As can be seen in the side view illustrated in FIG. 2 (*c*), the vicinity of both of the lower curved portions of the clip portion 11 are slanted forward at a first angle $\alpha$ relative to the top portion and middle portion of the part that forms an essentially inverse V when the center of the clip portion is viewed from the front, thereby forming guide portions 13 and 13 for capturing the end part of a metallic filament.

Furthermore, the upper portion of the clip portion 11, excluding the guide portions 13 and 13 of the outer wire portions of essentially V shapes on either side when viewed from the front, is, in its free state, slanted forward at a second angle $\beta$ relative to the guide portions 13 and 13, as can be seen in the side view illustrated in FIG. 2 (*c*), the second angle $\beta$ being greater than the first angle $\alpha$. Double-coil coiled portions 14 and 14 are formed in the vicinity of the upper end of the stated outer wire portions.

As shown in FIG. 2 (*a*), the attachment arm portions 12 and 12 are, in their free states, angled forward relative to a line k, shown in FIG. 2 (*a*), that connects the upper ends of the W shape of the clip portion 11; the tips of the attachment arm portions 12 and 12 are bent even further forward.

Furthermore, the top bent portion in the center of the clip portion 11 is positioned higher than the line k that connects the upper ends of the W shape of the clip portion 11, when viewed from the front, as shown in FIG. 2 (*b*).

The metallic filament end retaining clip 10 is arranged on the flange outer surface 2, making contact therewith, as shown in FIG. 1; the top bent portion in the center of the clip portion 11 is inserted into the space between the flange outer periphery portion 4 and the flange outer surface 2, and the attachment arm portions 12 and 12 on both sides are respectively fitted into the interior of the flange outer periphery portion 4.

The space 3 in the flange outer periphery portion 4 is set to a minimum size that still allows for the insertion of the top bent portion in the center of the clip portion 11 of the metallic filament end retaining clip 10 and for the fitting of the attachment arm portions 12 and 12 into the interior of the flange outer periphery portion. The wire of which the metallic filament end retaining clip 10 is configured of is, for example, approximately 1 mm thick. Such being the case, the space 3 of the flange outer periphery portion 4 may be approximately 1.1 to 1.3 mm.

The metallic filament end retaining clip 10 mounted in this manner is held by the flange outer periphery portion 4 due to the top bent portion in the center of the clip portion 11 and the attachment arm portions 12 and 12 pressing apart from one another within the flange outer periphery portion 4, and the essentially inverse V-shaped portion in the center of the clip portion 11 presses down upon the flange outer surface 2 due to elastic force caused by deformation of the attachment arm portions 12 and 12 that have been fitted into the flange outer periphery portion 4. Furthermore, the outer wire portions of the approximately V-shaped portions on both sides of the clip portion 11 are pressed down upon the flange outer surface 2 side, and thus experience deformation, essentially overlapping with the approximately inverse V-shaped portion in the center of the clip portion 11 when viewed from the side. Due to the elastic force of the outer wire portions caused by this deformation and the elastic force of the coiled portions 14 and 14, the approximately inverse V-shaped portion is pressed upon the flange outer surface 2. Then, the metallic filament W is passed through the passage hole 5, and the end part thereof is drawn in between the clip portion 11 and the flange outer surface 2 along the guide portions 13 and 13, securely retaining the end part, as illustrated by the dash-double-dot line in FIG. 1.

The retaining force arising at this time can be adjusted by setting the relative angles at which the various portions of the clip portion 11 slant forward.

The space 3 of the flange outer periphery portion 4 maintains the same size after the clip has been mounted. For this reason, the metallic filament end retaining clip 10 can be removed from the space using a procedure opposite to that used at the time of mounting, making it possible to easily remove and replace a damaged metallic filament end retaining clip.

FIG. 3 is a front view of a metallic filament end retaining clip according to a variation on the abovementioned embodiment. A metallic filament end retaining clip 20 according to this variation is configured including single-coil coiled portions 24 and 24, as opposed to the metallic filament end retaining clip 10 described in the abovementioned embodiment, which uses double-coil coiled portions 24 and 24. Other configurational elements, such as a clip portion 21, attachment arm portions 22 and 22, and guide portions 23 and 23, are identical to the clip portion 11, the attachment arm portions 12 and 12, and the guide portions 13 and 13 of the above embodiment. The metallic filament end retaining clip 20 functions in the same manner as the metallic filament end retaining clip 10 described in the above embodiment.

Second Embodiment

FIGS. 4 through 6 illustrate a second embodiment of the present invention. FIG. 4 is a front view (a) and a cross-sectional view (b) of the vicinity of a flange outer periphery portion in a reel for metallic filament in which a metallic filament end retaining clip has been mounted; FIG. 5 is a front view (a) and a side view (b) of the metallic filament end retaining clip; and FIG. 6 is three diagrams (a), (b), and (c), illustrating a procedure for mounting the metallic filament end retaining clip.

The take-up reel for metallic filament according to this embodiment is what is known as a pressed reel, in which flanges 101, formed by press-molding steel plates and anchoring the steel plates onto both sides of a winding drum (not shown), that is itself formed of a steel plate, through welding.

The flange 101 has a hollow ring-shaped flange outer periphery portion 104 that curls outward in the axial direction of the reel across the entire circumference of the outer edge of a flange outer surface 102, forming a space 103 therebetween. Furthermore, the flange 101 is provided with a passage hole 105, in one area near the flange outer periphery portion 104, through which the end part of a metallic filament W is passed.

Two clip mounting portions 107 and 107 are formed, through press molding, in the flange 101 in the vicinity of the passage hole 105, on the outer wall that forms the flange outer surface 102, in an area near the flange outer periphery portion 104 (in one area per flange), and are aligned in the circumferential direction of the flange; each clip mounting portion 107 bulges outward in the axial direction of the reel, and the entire space therebehind forms an opening in the inner surface of the flange. The formation of the clip mounting portions 107 and 107 in turn forms clip mounting holes 106 and 106 that have slit-shaped openings at both ends in the radial direction of the flange, and therefore pass through in the radial direction of the flange. Furthermore, two clip tip retaining portions 109 and 109 are formed, through press molding, on the inner side of the two clip mounting portions 107 and 107 relative to the radial direction of the flange, and are aligned in the circumferential direction of the flange; each clip tip retaining portion bulges outward in the axial direction of the reel, and the entire space therebehind forms an opening in the inner surface of the flange. The formation of the clip tip retaining portions 109 and 109 in turn forms clip tip retaining holes 108 and 108 that have slit-shaped openings at both ends in the circumferential direction of the flange, and therefore pass through in the circumferential direction of the flange.

A metallic filament end retaining clip 110 is mounted on the flange 101, in a removable state, on the flange outer surface 102, via the two clip mounting portions 107 and 107 and the clip tip retaining portions 109 and 109.

The metallic filament end retaining clip 110 is made of steel wire, and as shown in FIG. 5 (*a*), assuming the metallic filament end retaining clip 110 is in its free state and viewed from the front, a clip portion 111 is formed therein, bent in an essentially U shape. Positioning attachment portions 112 and 112 are formed on both sides of the clip portion 111, bent in essentially inverse U shapes, extending to approximately midway in the vertical direction of the clip portion 111, and the ends of the positioning attachment portions 112 and 112 are bent out to the left and right, respectively, at approximately 90-degree angles, forming tip stoppers 112*a* and 112*a*.

As can be seen in the side view illustrated in FIG. 5 (*b*), the clip portion 111 is bent in what is essentially the center of the vertical direction so as to bulge forward in its free state. A guide portion 113 for capturing the end part of the metallic filament is formed in the clip portion 111 so that its bottom end portion slants forward. Furthermore, the positioning attachment portions 112 and 112 are slanted, in their free states, in the direction of the bulge of the clip portion 111, when viewed from the side.

The metallic filament end retaining clip 110 is arranged on the flange outer surface 102, making contact therewith, as shown in FIG. 6 (*a*); the positioning attachment portions 112 and 112 are inserted, along the flange outer surface 102, into the clip mounting holes 106 and 106, respectively, from the inner sides of the clip mounting holes 106 and 106 relative to the radial direction of the flange. Next, the positioning attachment portions 112 and 112 are pressed together from the left and right sides while being pressed down upon the flange outer surface 102, whereupon the retaining portions 112*a* and 112*a* on left and right tips of the positioning attachment portions 112 and 112 are inserted into the clip tip retaining holes 108 and 108, respectively, as shown in FIG. 6 (*b*). The tip stoppers 112*a* and 112*a* are thus retained by the clip tip retaining holes 108 and 108, respectively, as shown in FIG. 3 (*c*).

With the metallic filament end retaining clip 110 mounted in this manner, the positioning attachment portions 112 and 112 maintain the positioned state using the clip mounting portions 107 and 107 and the clip tip retaining portions 109 and 109; thus, the clip portion 111 undergoes elastic deformation and is pressed down upon the flange outer surface 102, as shown in FIG. 4 (*b*). Then, the metallic filament W is passed through the passage hole 105, and the end part thereof is drawn in between the clip portion 111 and the flange outer surface 102 along the guide portion 113, securely retaining the end part, as illustrated by the dash-double-dot line in FIG. 4 (*a*). This retaining force can be adjusted by setting the angle at which the clip portion 111 is bent forward. Furthermore, the metallic filament end retaining clip 110 can be removed using a procedure opposite to that used at the time of mounting, making it possible to easily remove and replace a damaged metallic filament end retaining clip.

Third Embodiment

FIGS. 7 and 8 illustrate a third embodiment of the present invention. FIG. 7 is a front view (a) and a cross-sectional view (b) of the vicinity of a flange outer periphery portion in a reel for metallic filament in which a metallic filament end retaining clip has been mounted, and FIG. 8 is a front view (a) and a side view (b) of the metallic filament end retaining clip.

The take-up reel for metallic filament according to this embodiment is what is known as a pressed reel, in which flanges 201, formed by press-molding steel plates and anchoring the steel plates onto both sides of a winding drum (not shown), that is itself formed of a steel plate, through welding.

The flange 201 has a hollow ring-shaped flange outer periphery portion 204 that curls outward in the axial direction of the reel across the entire circumference of the outer edge of a flange outer surface 202, forming a space 203 therebetween. Furthermore, the flange 201 is provided with a passage hole 205, in one area near the flange outer periphery portion 204, through which the end part of a metallic filament W is passed.

Two clip mounting portions 207 and 207 are formed, through press molding, in the flange 201 in the vicinity of the passage hole 205, on the outer wall that forms the flange outer surface 202, in an area near the flange outer periphery portion 204 (in one area per flange), and are aligned in the circumferential direction of the flange; each clip mounting portion 207 bulges outward in the axial direction of the reel, and the entire space therebehind forms an opening in the inner surface of the flange. The formation of the clip mounting portions 207 and 207 in turn forms clip mounting holes 206 and 206 that have slit-shaped openings at both ends in the radial direction of the flange, and therefore pass through in the radial direction of the flange.

A metallic filament end retaining clip 210 is mounted on the flange 201, in a removable state, on the flange outer surface 202, via the two clip mounting portions 207 and 207.

The metallic filament end retaining clip 210 is made of steel wire, and as shown in FIG. 8 (*a*), assuming the metallic filament end retaining clip 210 is in its free state and viewed from the front, a clip portion 211 is formed therein, bent in an essentially U shape, with the open end thereof tapered inward. Positioning attachment portions 212 and 212 are formed on both sides of the clip portion 211, bent in essentially inverse U shapes with the open ends thereof slightly spread outward, and extending to approximately midway in the vertical direction of the clip portion 211. The ends of the positioning attachment portions 112 and 112 are bent out to the left and right, respectively, at approximately 90-degree angles, forming tip stoppers 212*a* and 212*a*, and furthermore, bent stoppers 212*b* and 212*b* are formed in a protruding shape, in the left and right outer sides of what is essentially the center of the inverse U shapes, by bending the wire.

As can be seen in the side view illustrated in FIG. 8 (*b*), the clip portion 211 is bent in what is essentially the center of the vertical direction so as to bulge forward in its free state. A guide portion 213 for capturing the end part of the metallic filament is formed in the clip portion 211 so that its bottom end portion slants forward. Furthermore, the positioning attachment portions 212 and 212 are bent, in their free states, so as to overlap with the clip portion 211, when viewed from the side.

As shown in FIG. 7, the metallic filament end retaining clip 210 is arranged on the flange outer surface 202, making contact therewith; the positioning attachment portions 212 and 212 are pressed together from the left and right sides while being pressed down upon the flange outer surface 202, and are inserted, along the flange outer surface 202, into the clip mounting holes 206 and 206, respectively, from the inner sides of the clip mounting holes 206 and 206 relative to the radial direction of the flange. The top bent portions of the positioning attachment portions 212 and 212 are inserted into the space 203 between the flange outer periphery portion 204 and the flange outer surface 202. The tip stoppers 212*a* and 212*a* on the left and right tips of the positioning attachment portions 212 and 212 extend out of the clip mounting holes 206 and 206 beneath the clip mounting portions 207 and 207, whereas the bent stoppers 212*b* and 212*b* extend out of the clip mounting holes 206 and 206 above the clip mounting portions 207 and 207. The tip stoppers 212*a* and 212*a* and the bent stoppers 212*b* and 212*b* stop and position the metallic filament end retaining clip 210.

With the metallic filament end retaining clip 210 mounted in this manner, the positioning attachment portions 212 and 212 maintain the positioned state using the clip mounting portions 207 and 207 and the space 203 of the flange outer periphery portion 204; thus, the clip portion 211 undergoes elastic deformation and is pressed down upon the flange outer surface 202, as shown in FIG. 7 (*b*). Then, the metallic filament W is passed through the passage hole 205, and the end part thereof is drawn in between the clip portion 211 and the flange outer surface 202 along the guide portion 213, securely retaining the end part, as illustrated by the dash-double-dot line in FIG. 7 (*a*). Meanwhile, this retaining force can be adjusted by setting the angle at which the clip portion 211 is bent forward. Furthermore, the metallic filament end retaining clip 210 can be removed using a procedure opposite to that used at the time of mounting, making it possible to easily remove and replace a damaged metallic filament end retaining clip.

Fourth Embodiment

FIGS. 9 and 10 illustrate a fourth embodiment of the present invention. FIG. 9 is a front view (a) and a cross-sectional view (b) of the vicinity of a flange outer periphery portion in a reel for metallic filament in which a metallic filament end retaining clip has been mounted, and FIG. 10 is a front view (a) and a side view (b) of the metallic filament end retaining clip.

The take-up reel for metallic filament according to this embodiment is what is known as a pressed reel, in which flanges 301, formed by press-molding steel plates and anchoring the steel plates onto both sides of a winding drum (not shown), that is itself formed of a steel plate, through welding.

The flange 301 has a hollow ring-shaped flange outer periphery portion 304 that curls outward in the axial direction of the reel across the entire circumference of the outer edge of a flange outer surface 302, forming a space 303 therebetween. Furthermore, the flange 301 is provided with a passage hole 305, in one area near the flange outer periphery portion 304, through which the end part of a metallic filament W is passed.

Two clip mounting portions 307 and 307 are formed, through press molding, in the flange 301 in the vicinity of the passage hole 305, on the outer wall that forms the flange outer surface 302, in an area near the flange outer periphery portion 304 (in one area per flange), and are aligned in the circumferential direction of the flange; each clip mounting portion 307 bulges outward in the axial direction of the reel, and the entire space therebehind forms an opening in the inner surface of the flange. The formation of the clip mounting portions 307 and 307 in turn forms clip mounting holes 306 and 306 that have slit-shaped openings at both ends in the radial direction of the flange, and therefore pass through in the radial direction of the flange.

A metallic filament end retaining clip 310 is mounted on the flange 301, in a removable state, on the flange outer surface 302, via the two clip mounting portions 307 and 307.

The metallic filament end retaining clip 310 is made of steel wire, and as shown in FIG. 10 (*a*), assuming the metallic filament end retaining clip 310 is in its free state and viewed from the front, a clip portion 311 is formed therein, bent in a wide, essentially U shape, with the open end thereof slightly tapered outward. Positioning attachment portions 312 and 312 are formed opposing one another with a space therebetween, on the inner sides of opening of the clip portion 311, bent inward from both ends of the opening in essentially inverse U shapes with the open ends thereof slightly tapered outward, and extending to approximately midway in the vertical direction of the clip portion 311. The ends of the positioning attachment portions 312 and 312 are bent in at approximately 90-degree angles, forming tip stoppers 312*a* and 312*a*, and furthermore, bent stoppers 312*b* and 312*b* are formed, by bending the wire in a shape protruding outward, in the outer sides of what is essentially the center of the outer wire portions.

As can be seen in the side view illustrated in FIG. 10 (*b*), the clip portion 311 is bent in what is essentially the center of the vertical direction so as to bulge forward in its free state. A guide portion 313 for capturing the end part of the metallic filament is formed in the clip portion 311 so that its bottom end portion slants forward. Furthermore, the lower ends of the positioning attachment portions 312 and 312 are slightly slanted backward in their free states, when viewed from the side.

As shown in FIG. 9, the metallic filament end retaining clip 310 is arranged on the flange outer surface 302, making contact therewith; the positioning attachment portions 312 and 312 are pressed together from the left and right sides while being pressed down upon the flange outer surface 302, and are inserted, along the flange outer surface 302, into the clip mounting holes 306 and 306, respectively, from the inner sides of the clip mounting holes 306 and 306 relative to the radial direction of the flange. The top bent portions of the positioning attachment portions 312 and 312 are inserted into the space 303 between the flange outer periphery portion 304 and the flange outer surface 302. The tip stoppers 312*a* and 312*a* extend out of the clip mounting holes 306 and 306 beneath the clip mounting portions 307 and 307, whereas the bent stoppers 312*b* and 312*b* extend out of the clip mounting holes 306 and 306 above the clip mounting portions 307 and 307. The tip stoppers 312*a* and 312*a* and the bent stoppers 312*b* and 312*b* stop and position the metallic filament end retaining clip 310.

With the metallic filament end retaining clip 310 mounted in this manner, the positioning attachment portions 312 and 312 maintain the positioned state using the clip mounting portions 307 and 307 and the space 203 of the flange outer periphery portion 304; thus, the clip portion 311 undergoes elastic deformation and is pressed down upon the flange outer surface 302, as shown in FIG. 9 (*b*). Then, the metallic filament W is passed through the passage hole 305, and the end part thereof is drawn in between the clip portion 311 and the flange outer surface 302 along the guide portion 313, securely retaining the end part, as illustrated by the dash-double-dot line in FIG. 9 (*a*). Meanwhile, this retaining force can be adjusted by setting the angle at which the clip portion 311 is bent forward. Furthermore, the metallic filament end retaining clip 310 can be removed using a procedure opposite to that used at the time of mounting, making it possible to easily remove and replace a damaged metallic filament end retaining clip.

Fifth Embodiment

FIGS. 11 and 12 illustrate a fifth embodiment of the present invention. FIG. 11 is a front view (a) and a cross-sectional view (b) of the vicinity of a flange outer periphery portion in a reel for metallic filament in which a metallic filament end retaining clip has been mounted, and FIG. 12 is a front view (a) and a side view (b) of the metallic filament end retaining clip.

The take-up reel for metallic filament according to this embodiment is what is known as a pressed reel, in which flanges 401, formed by press-molding steel plates and anchoring the steel plates onto both sides of a winding drum (not shown), that is itself formed of a steel plate, through welding.

The flange 401 has a hollow ring-shaped flange outer periphery portion 404 that curls outward in the axial direction of the reel across the entire circumference of the outer edge of a flange outer surface 402, forming a space 403 therebetween. Furthermore, the flange 401 is provided with a passage hole 405, in one area near the flange outer periphery portion 404, through which the end part of a metallic filament W is passed.

Two clip mounting portions 407 and 407 are formed, through press molding, in the flange 401 in the vicinity of the passage hole 405, on the outer wall that forms the flange outer surface 402, in an area near the flange outer periphery portion 404 (in one area per flange), and are aligned in the circumferential direction of the flange; each clip mounting portion 407 bulges outward in the axial direction of the reel, and the entire space therebehind forms an opening in the inner surface of the flange. The formation of the clip mounting portions 407 and 407 in turn forms clip mounting holes 406 and 406 that have slit-shaped openings at both ends in the radial direction of the flange, and therefore pass through in the radial direction of the flange.

A metallic filament end retaining clip 410 is mounted on the flange 401, in a removable state, on the flange outer surface 402, via the two clip mounting portions 407 and 407.

The metallic filament end retaining clip 410 is made of steel wire, and as shown in FIG. 12 (*a*), assuming the metallic filament end retaining clip 410 is in its free state and viewed from the front, a clip portion 411 is formed therein, bent in a wide, essentially U shape. A left positioning attachment portion 412A is formed on the left side of the opening of the clip portion 411, bent in an essentially inverse U shape, extending to approximately midway in the vertical direction of the clip portion 411, and the end of the positioning attachment portion 412A is bent out at an approximately 90-degree angle, forming a tip stopper 412A-a. Furthermore, a right positioning attachment portion 412B is formed on the right side of the opening of the clip portion 411, bent in an essentially inverse U shape that surrounds the clip portion 411, and extending to within the top part of the U shape formed by the left positioning attachment portion 412A; the end of the positioning attachment portion 412B is bent in at an approximately 90-degree angle, forming a tip stopper 412B-a, and furthermore, left and right bent stoppers 412B-b and 412B-b are formed, by bending the wire, in a shape protruding backward, at the same height as the tip stopper 412A-a of the left positioning attachment portion 412A.

As can be seen in the side view illustrated in FIG. 12 (*b*), the clip portion 411 is bent in what is essentially the center of the vertical direction so as to bulge forward in its free state. A guide portion 413 for capturing the end part of the metallic filament is formed in the clip portion 411 so that its bottom end portion slants forward. Furthermore, the left and right positioning attachment portions 412A and 412B are essentially vertical in their free states, as viewed from the side.

As shown in FIG. 11, the metallic filament end retaining clip 410 is arranged on the flange outer surface 402, making contact therewith; the positioning attachment portions 412A and 412B are pressed together from the left and right sides while being pressed down upon the flange outer surface 402, and are inserted, along the flange outer surface 402, into the clip mounting holes 406 and 406, respectively, from the inner sides of the clip mounting holes 406 and 406 relative to the radial direction of the flange. The top bent portions of the positioning attachment portions 412A and 412B are inserted into the space 403 between the flange outer periphery portion 404 and the flange outer surface 402. The left tip stopper 412A-a extends out of the left clip mounting hole 406 beneath the left clip mounting portion 407, right tip stopper 412B-a is retained in the space 403 of the flange outer periphery portion 404, and the bent stoppers 412B-b and 412B-b extend backward out of the clip mounting holes 406 and 406 beneath the clip mounting portions 407 and 407. The tip stoppers 412*a-a* and 412B-a and the bent stoppers 412B-b and 412B-b stop and position the metallic filament end retaining clip 410.

With the metallic filament end retaining clip 410 mounted in this manner, the positioning attachment portions 412A and 412B maintain the positioned state using the clip mounting portions 407 and 407 and the space 403 of the flange outer periphery portion 404; thus, the clip portion 411 undergoes elastic deformation and is pressed down upon the flange outer surface 402. Then, the metallic filament W is passed through the passage hole 405, and the end part thereof is drawn in between the clip portion 411 and the flange outer surface 402 along the guide portion 413, securely retaining the end part, as illustrated by the dash-double-dot line in FIG. 11 (*a*). Meanwhile, this retaining force can be adjusted by setting the angle at which the clip portion 411 is bent forward. Furthermore, the metallic filament end retaining clip 410 can be removed using a procedure opposite to that used at the time of mounting, making it possible to easily remove and replace a damaged metallic filament end retaining clip.

Sixth Embodiment

FIGS. 13 and 14 illustrate a sixth embodiment of the present invention. FIG. 13 is a front view (a) and a cross-sectional view (b) of the vicinity of a flange outer periphery portion in a reel for metallic filament in which a metallic filament end retaining clip has been mounted, and FIG. 14 is a front view (a) and a side view (b) of the metallic filament end retaining clip.

The take-up reel for metallic filament according to this embodiment is what is known as a pressed reel, in which flanges 501, formed by press-molding steel plates and anchoring the steel plates onto both sides of a winding drum (not shown), that is itself formed of a steel plate, through welding.

The flange 501 has a hollow ring-shaped flange outer periphery portion 504 that curls outward in the axial direction of the reel across the entire circumference of the outer edge of a flange outer surface 502, forming a space 503 therebetween. Furthermore, the flange 501 is provided with a passage hole 505, in one area near the flange outer periphery portion 504, through which the end part of a metallic filament W is passed.

One clip mounting portion 507 is formed, through press molding, in the flange 501 in the vicinity of the passage hole 505, on the outer wall that forms the flange outer surface 502, in an area near the flange outer periphery portion 504 (in one area per flange); the clip mounting portion 507 bulges outward in the axial direction of the reel, and the entire space therebehind forms an opening in the inner surface of the flange. The formation of the clip mounting portion 507 in turn forms a clip mounting hole 506 that has slit-shaped openings at both ends in the radial direction of the flange, and therefore passes through in the radial direction of the flange.

A metallic filament end retaining clip 510 is mounted on the flange 501, in a removable state, on the flange outer surface 502, via the clip mounting portion 507.

The metallic filament end retaining clip 510 is made of steel wire, and as shown in FIG. 14 (*a*), assuming the metallic filament end retaining clip 510 is in its free state and viewed from the front, a clip portion 511 is formed therein, bent in an essentially U shape, with the open end thereof tapered outward. Positioning attachment portions 512 and 512 are formed on both sides of the opening of the clip portion 511. The ends of the positioning attachment portions 512 and 512 are bent out to the left and right, respectively, at approximately 90-degree angles, forming tip stoppers 512*a* and 512*a*, on both sides of the opening, and furthermore, bent stoppers 512*b* and 512*b* are formed by bending the wire in a shape protruding to the left and right of the outer sides of the portion that connects the positioning attachment portions 512 and 512 to the clip portion 511.

As can be seen in the side view illustrated in FIG. 14 (*b*), the clip portion 511 and the positioning attachment portions 512 and 512 extending above therefrom are bent in what is essentially the center of the vertical direction so as to bulge forward in their free states. A guide portion 513 for capturing the end part of the metallic filament is formed in the clip portion 511 so that its bottom end portion slants forward.

As shown in FIG. 13, the metallic filament end retaining clip 510 is arranged on the flange outer surface 502, making contact therewith; the positioning attachment portions 512 and 512 are pressed together from the left and right sides while being pressed down upon the flange outer surface 502, and are inserted, along the flange outer surface 502, into the clip mounting holes 506 and 506, respectively, from the inner sides of the clip mounting holes 506 and 506 relative to the radial direction of the flange. The tip stoppers 512*a* and 512*a* of the positioning attachment portions 512 and 512 are inserted into the space 503 between the flange outer periphery portion 504 and the flange outer surface 502. The bent stoppers 512*b* and 512*b* extend out of the clip mounting holes 506 and 506 above the clip mounting portions 507 and 507. The tip stoppers 512*a* and 512*a* and the bent stoppers 512*b* and 512*b* stop and position the metallic filament end retaining clip 510.

With the metallic filament end retaining clip 510 mounted in this manner, the positioning attachment portions 512 and 512 maintain the positioned state using the clip mounting portions 507 and 507 and the space 503 of the flange outer periphery portion 504; thus, the clip portion 511 undergoes elastic deformation and is pressed down upon the flange outer surface 502, as shown in FIG. 13 (*b*). Then, the metallic filament W is passed through the passage hole 505, and the end part thereof is drawn in between the clip portion 511 and the flange outer surface 502 along the guide portion 513, securely retaining the end part, as illustrated by the dash-double-dot line in FIG. 13 (*a*). Meanwhile, this retaining force can be adjusted by setting the angle at which the clip portion 511 is bent forward. Furthermore, the metallic filament end retaining clip 510 can be removed using a procedure opposite to that used at the time of mounting, making it possible to easily remove and replace a damaged metallic filament end retaining clip.

Seventh Embodiment

FIGS. 15 and 16 illustrate a seventh embodiment of the present invention. FIG. 15 is a front view (a) and a cross-sectional view (b) of the vicinity of a flange outer periphery portion in a reel for metallic filament in which a metallic filament end retaining clip has been mounted, and FIG. 16 is a front view (a) and a side view (b) of the metallic filament end retaining clip.

The take-up reel for metallic filament according to this embodiment is what is known as a pressed reel, in which flanges 601, formed by press-molding steel plates and anchoring the steel plates onto both sides of a winding drum (not shown), that is itself formed of a steel plate, through welding.

The flange 601 has a hollow ring-shaped flange outer periphery portion 604 that curls outward in the axial direction of the reel across the entire circumference of the outer edge of a flange outer surface 602, forming a space 603 therebetween. Furthermore, the flange 601 is provided with a passage hole 605, in one area near the flange outer periphery portion 604, through which the end part of a metallic filament W is passed.

One clip mounting portion 607 is formed, through press molding, in the flange 601 in the vicinity of the passage hole 605, on the outer wall that forms the flange outer surface 602, in an area near the flange outer periphery portion 604 (in one area per flange); the clip mounting portion 607 bulges outward in the axial direction of the reel, and the entire space therebehind forms an opening in the inner surface of the flange. The formation of the clip mounting portion 607 in turn forms a clip mounting hole 606 that has slit-shaped openings at both ends in the radial direction of the flange, and therefore passes through in the radial direction of the flange.

A metallic filament end retaining clip 610 is mounted on the flange 601, in a removable state, on the flange outer surface 602, via the clip mounting portion 607.

The metallic filament end retaining clip 610 is made of steel wire, and as shown in FIG. 16 (*a*), assuming the metallic filament end retaining clip 610 is in its free state and viewed from the front, a clip portion 611 is formed therein, the overall clip portion 611 being bent in an essentially W shape with a high center, formed by an essentially inverse U shape in the center connected to an essentially U shape on both sides. Positioning attachment portions 612 and 612 are formed on both sides of the clip portion 611, extending upward from the upper ends of the W shape. The ends of the positioning attachment portions 612 and 612 are bent out to the left and right, respectively, at approximately 90-degree angles, forming tip stoppers 612*a* and 612*a*, and furthermore, bent stoppers 612*b* and 612*b* are formed, by bending the wire, in a shape protruding backward, in the portions that connect the positioning attachment portions 612 and 612 to the clip portion 611.

As can be seen in the side view illustrated in FIG. 16 (*b*), the clip portion 611 is formed with the central wire portion that makes up the inverse U shape being bent in what is essentially the center of the vertical direction so as to bulge forward in its free state, and with the wire portions that make up the left and right sides of the W shape extending approximately linearly in the direction that overlaps with the top end portion of the central wire portion, the bottom end portions thereof slanting forward, thereby forming guide portions 613 and 613 for capturing the end part of the metallic filament. Furthermore, the positioning attachment portions 612 and 612 extend approximately linearly, in their free states, so as to overlap with the top end portion of the clip portion 611, when viewed from the side.

As shown in FIG. 15, the metallic filament end retaining clip 610 is arranged on the flange outer surface 602, making contact therewith; the positioning attachment portions 612 and 612 are pressed together from the left and right sides while being pressed down upon the flange outer surface 602, and the entire metallic filament end retaining clip 610 is inserted, along the flange outer surface 602, into the clip mounting hole 606 from the inner side of the clip mounting hole 606 relative to the radial direction of the flange. The bent portion in the top center of the clip portion 611 and the tip stoppers 612*a* and 612*a* of the positioning attachment portions 612 and 612 are inserted into the space 603 between the flange outer periphery portion 604 and the flange outer surface 602. The bent stoppers 612*b* and 612*b* extend out of the clip mounting hole 606 beneath the clip mounting portion 607. The tip stoppers 612*a* and 612*a* and the bent stoppers 612*b* and 612*b* stop and position the metallic filament end retaining clip 610.

With the metallic filament end retaining clip 610 mounted in this manner, the positioning attachment portions 612 and 612 maintain the positioned state using the clip mounting portion 607 and the space 603 of the flange outer periphery portion 604; thus, the clip portion 611 undergoes elastic deformation and is pressed down upon the flange outer surface 602, as shown in FIG. 15 (*b*). Then, the metallic filament W is passed through the passage hole 605, and the end part thereof is drawn in between the clip portion 611 and the flange outer surface 602 along the guide portions 613 and 613, securely retaining the end part, as illustrated by the dash-double-dot line in FIG. 15 (*a*). Meanwhile, this retaining force can be adjusted by setting the angle at which the clip portion 611 is bent forward. Furthermore, the metallic filament end retaining clip 610 can be removed using a procedure opposite to that used at the time of mounting, making it possible to easily remove and replace a damaged metallic filament end retaining clip.

Eighth Embodiment

FIGS. 17 and 18 illustrate an eighth embodiment of the present invention. FIG. 17 is a front view (a) and a cross-sectional view (b) of the vicinity of a flange outer periphery portion in a reel for metallic filament in which a metallic filament end retaining clip has been mounted, and FIG. 18 is a front view (a) and a side view (b) of the metallic filament end retaining clip.

The take-up reel for metallic filament according to this embodiment is what is known as a pressed reel, in which flanges 701, formed by press-molding steel plates and anchoring the steel plates onto both sides of a winding drum (not shown), that is itself formed of a steel plate, through welding.

The flange 701 has a hollow ring-shaped flange outer periphery portion 704 that curls outward in the axial direction of the reel across the entire circumference of the outer edge of a flange outer surface 702, forming a space 703 therebetween. Furthermore, the flange 701 is provided with a passage hole 705, in one area near the flange outer periphery portion 704, through which the end part of a metallic filament W is passed.

One clip mounting portion 707 is formed, through press molding, in the flange 701 in the vicinity of the passage hole 705, on the outer wall that forms the flange outer surface 702, in an area near the flange outer periphery portion 704 (in one area per flange); the clip mounting portion 707 bulges outward in the axial direction of the reel, and the entire space therebehind forms an opening in the inner surface of the flange. The formation of the clip mounting portion 707 in turn forms a clip mounting hole 706 that has slit-shaped openings at both ends in the radial direction of the flange, and therefore passes through in the radial direction of the flange. A rectangular hole 708 is furthermore formed in the center of the front of the clip mounting portion 707, opening into the clip mounting hole 706.

A metallic filament end retaining clip 710 is mounted on the flange 701, in a removable state, on the flange outer surface 702, via the clip mounting portion 707.

The metallic filament end retaining clip 710 is made of steel wire, and as shown in FIG. 18 (*a*), assuming the metallic filament end retaining clip 710 is in its free state and viewed from the front, a clip portion 711 is formed therein, the overall clip portion 711 being bent in an essentially W shape with a high center, formed by an essentially inverse U shape in the center connected to an essentially U shape on both sides. Bent stoppers 711*a* and 711*a* are formed in the clip portion 711 by bending the wire, in a shape protruding forward, in the upper area of the central wire portion that makes up the inverse U shape. Positioning attachment portions 712 and 712 are formed on both sides of the clip portion 711, extending upward from the upper ends of the W shape. The ends of the positioning attachment portions 712 and 712 are bent out to the left and right, respectively, at approximately 90-degree angles, forming tip stoppers 712*a* and 712*a*, and furthermore, bent stoppers 712*b* and 712*b* are formed, by bending the wire, in a shape protruding backward, in the portions that connect the positioning attachment portions 712 and 712 to the clip portion 711.

As can be seen in the side view illustrated in FIG. 18 (*b*), the clip portion 711 is formed with the central wire portion that makes up the inverse U shape being bent in what is essentially the center of the vertical direction so as to bulge forward in its free state, and with the wire portions that make up the left and right sides of the W shape extending approximately linearly in the direction that overlaps with the top end portion of the central wire portion, the bottom end portions thereof slanting forward, thereby forming guide portions 713 and 713 for capturing the end part of the metallic filament. Furthermore, the positioning attachment portions 712 and 712 extend approximately linearly, in their free states, so as to overlap with the top portion of the clip portion 711, when viewed from the side.

As shown in FIG. 17, the metallic filament end retaining clip 710 is arranged on the flange outer surface 702, making contact therewith; the positioning attachment portions 712 and 712 are pressed together from the left and right sides while being pressed down upon the flange outer surface 702, and the entire metallic filament end retaining clip 710 is inserted, along the flange outer surface 702, into the clip mounting hole 706 from the inner side of the clip mounting hole 706 relative to the radial direction of the flange. The bent portion in the top center of the clip portion 711 and the tip stoppers 712*a* and 712*a* of the positioning attachment portions 712 and 712 are inserted into the space 703 between the flange outer periphery portion 704 and the flange outer surface 702. The bent stoppers 711*a* and 711*a* of the clip portion 711 are fitted into the rectangular hole 708 in the center of the front of the clip mounting portion 707, whereas the left and right bent stoppers 712*b* and 712*b* extend out of the clip mounting hole 706 beneath the clip mounting portion 707. The tip stoppers 712*a* and 712*a* and the bent stoppers 711*a* and 711*a*, and the left and right bent stoppers 712*b* and 712*b*, stop and position the metallic filament end retaining clip 710.

With the metallic filament end retaining clip 710 mounted in this manner, the positioning attachment portions 712 and 712 maintain the positioned state using the clip mounting portion 707 and the space 703 of the flange outer periphery portion 704; thus, the clip portion 711 undergoes elastic deformation and is pressed down upon the flange outer surface 702, as shown in FIG. 17 (*b*). Then, the metallic filament W is passed through the passage hole 705, and the end part thereof is drawn in between the clip portion 711 and the flange outer surface 702 along the guide portions 713 and 713, securely retaining the end part, as illustrated by the dash-double-dot line in FIG. 17 (*a*). Meanwhile, this retaining force can be adjusted by setting the angle at which the clip portion 711 is bent forward. Furthermore, the metallic filament end retaining clip 710 can be removed using a procedure opposite to that used at the time of mounting, making it possible to easily remove and replace a damaged metallic filament end retaining clip.

DESCRIPTION OF REFERENCE NUMERALS

Figure 1:
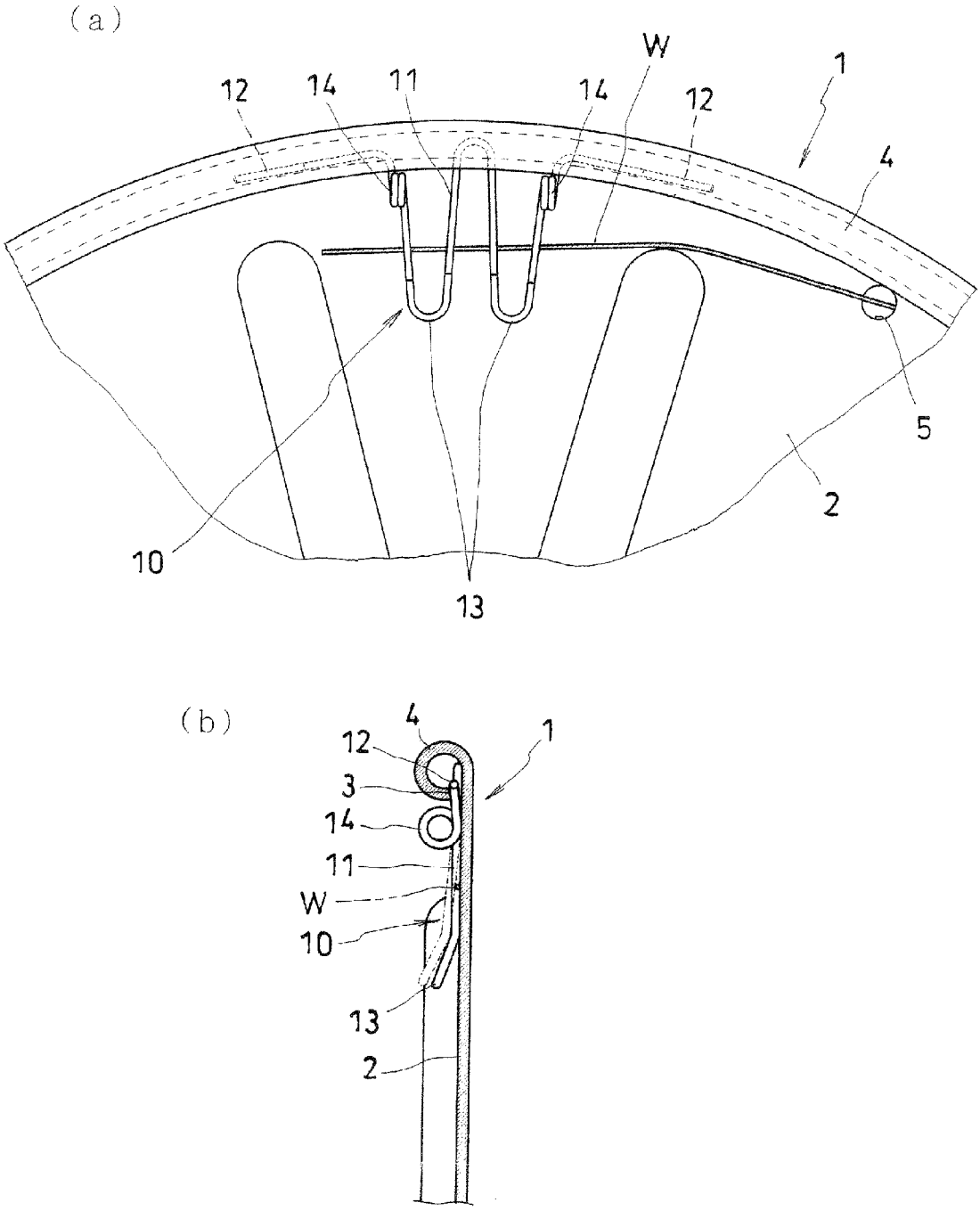
FIG. 1 is a front view (a) and a cross-sectional view (b) of the vicinity of a flange outer periphery portion in a reel for metallic filament in which a metallic filament end retaining clip has been mounted, according to a first embodiment of the present invention.
Figure 2:
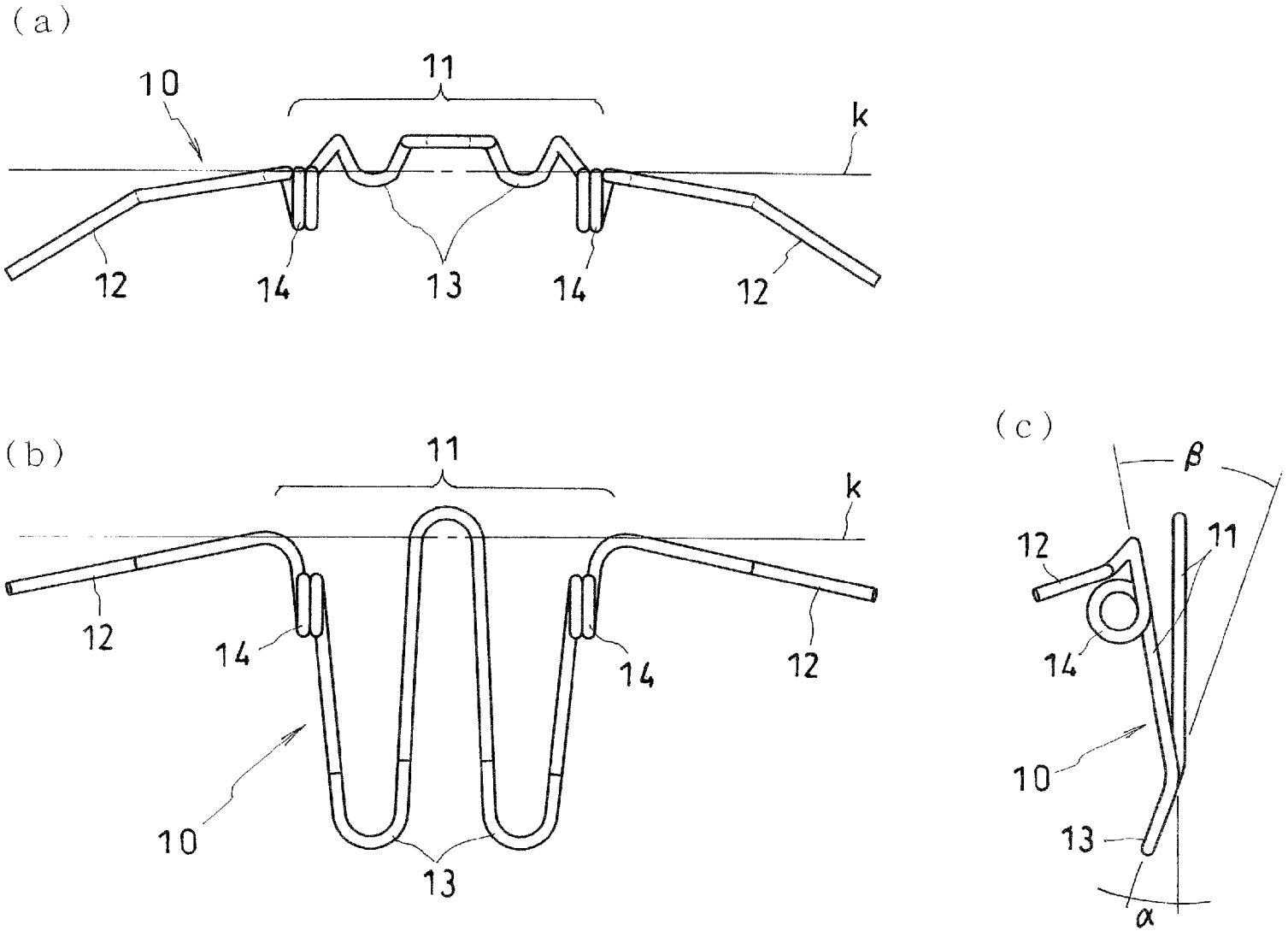
FIG. 2 is a plan view (a), a front view (b), and a side view (c) of the metallic filament end retaining clip according to the first embodiment of the present invention.
Figure 3:
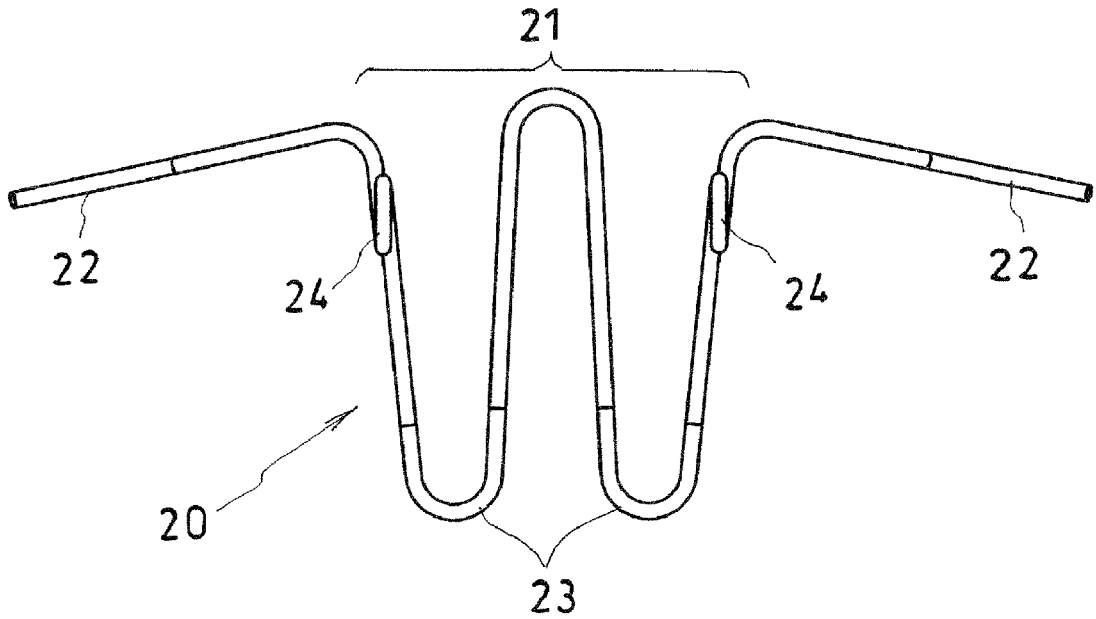
FIG. 3 is a front view of a metallic filament end retaining clip according to a variation on the first embodiment of the present invention.
Figure 4:
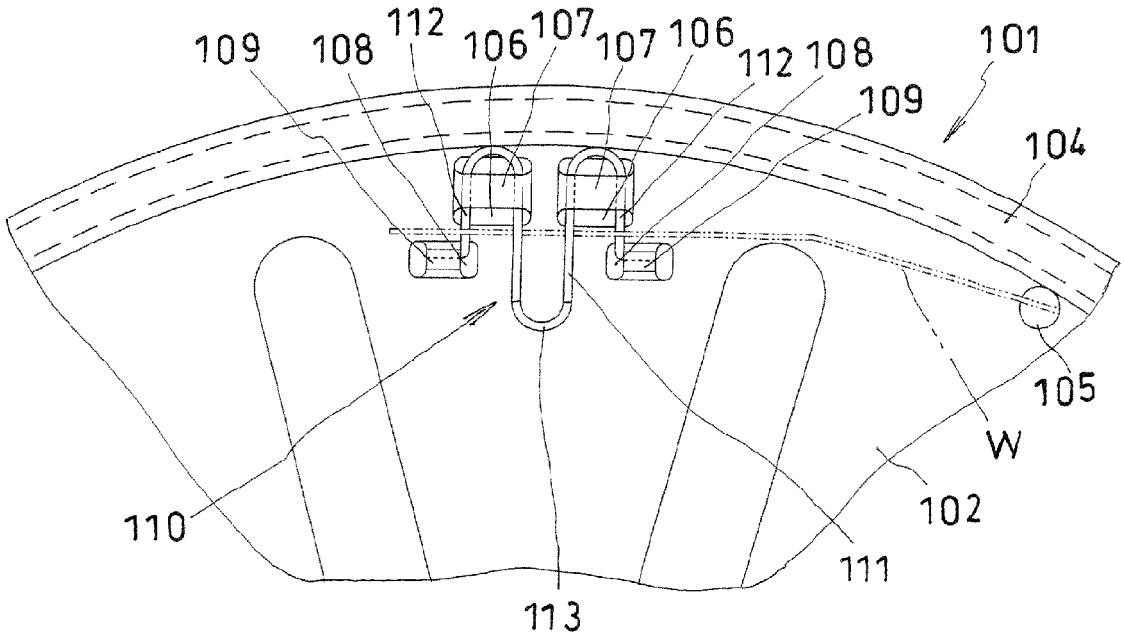
FIG. 4 is a front view (a) and a cross-sectional view (b) of the vicinity of a flange outer periphery portion in a reel for metallic filament in which a metallic filament end retaining clip has been mounted, according to a second embodiment of the present invention.
Figure 4:
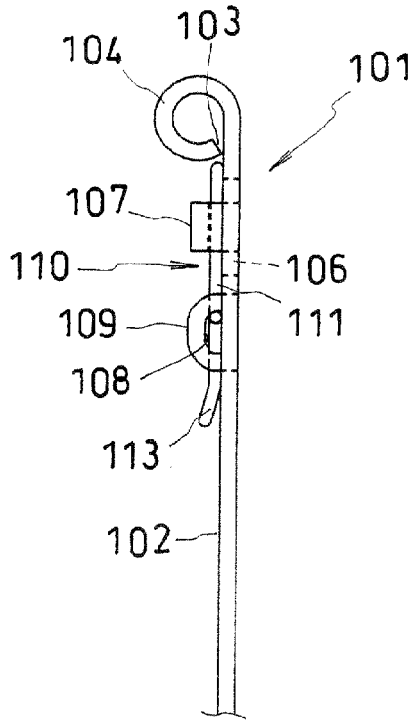
Figure 5:
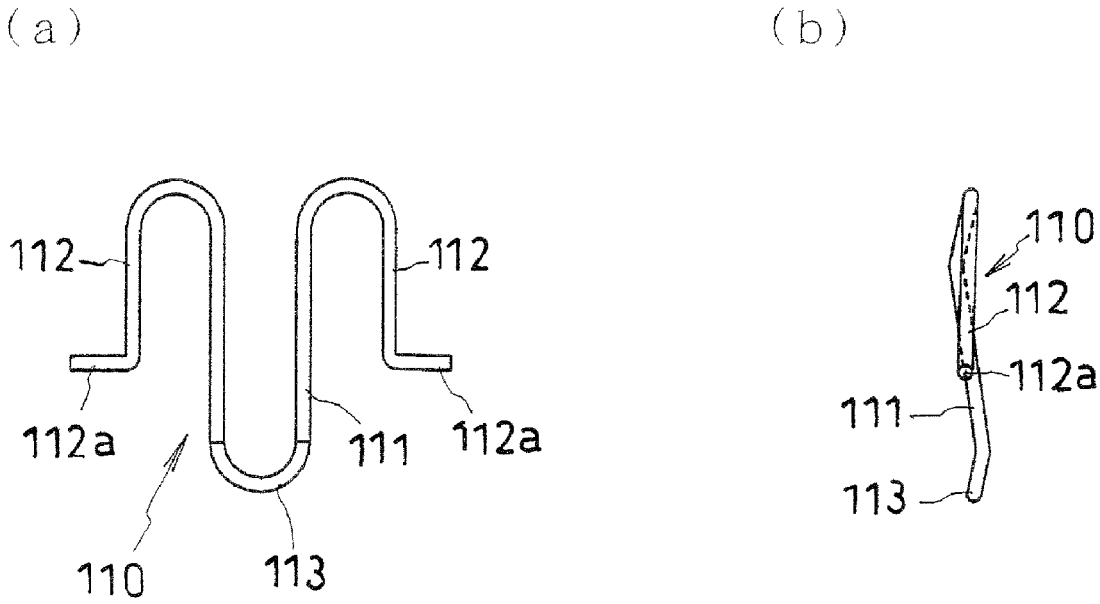
FIG. 5 is a front view (a) and a side view (b) of the metallic filament end retaining clip according to the second embodiment of the present invention.
Figure 6:
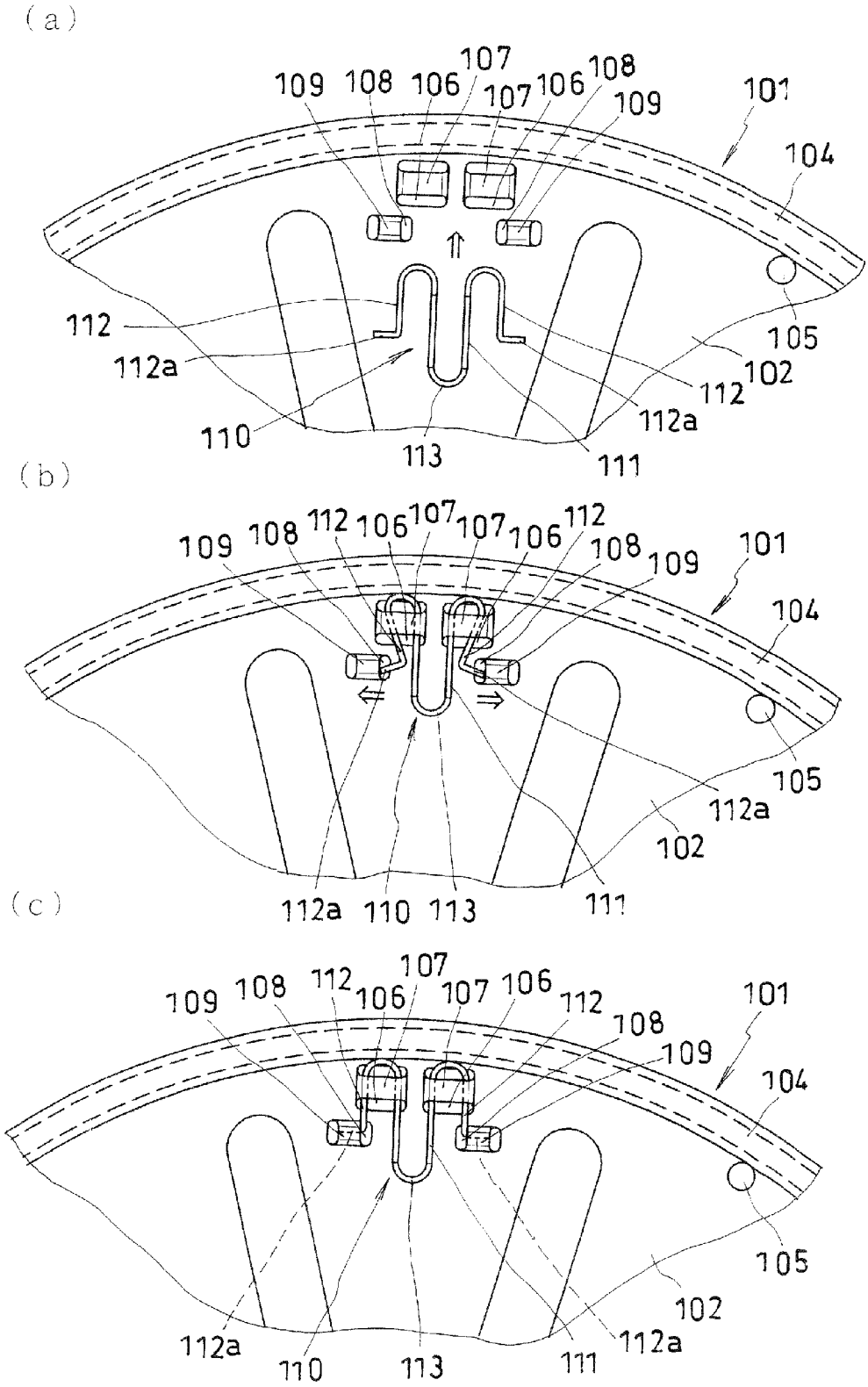
FIG. 6 contains three diagrams (a), (b), and (c), illustrating a procedure for mounting the metallic filament end retaining clip according to the second embodiment of the present invention.
Figure 7:
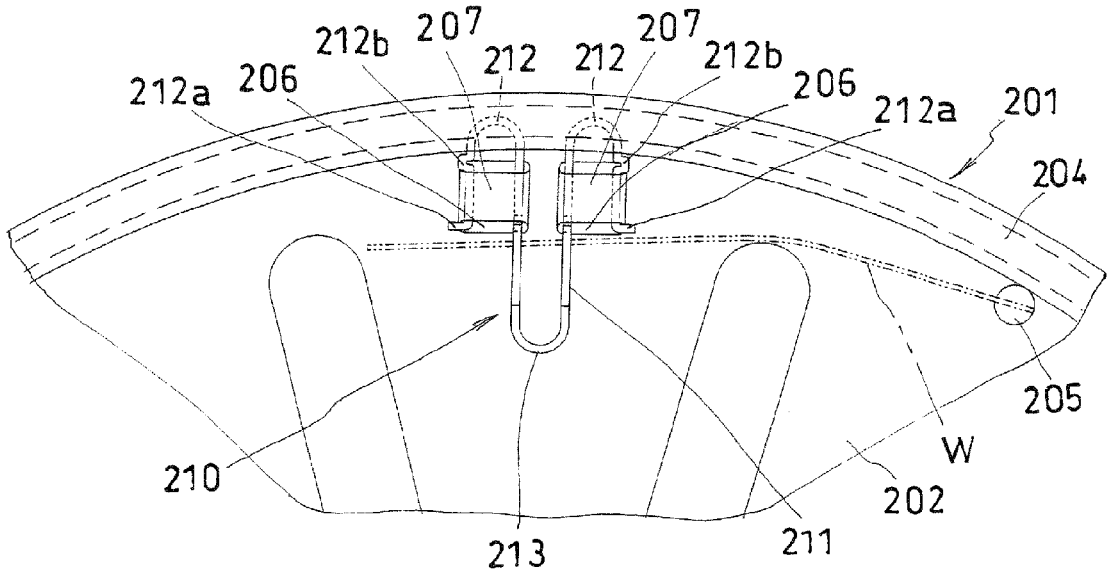
FIG. 7 is a front view (a) and a cross-sectional view (b) of the vicinity of a flange outer periphery portion in a reel for metallic filament in which a metallic filament end retaining clip has been mounted, according to a third embodiment of the present invention.
Figure 7:
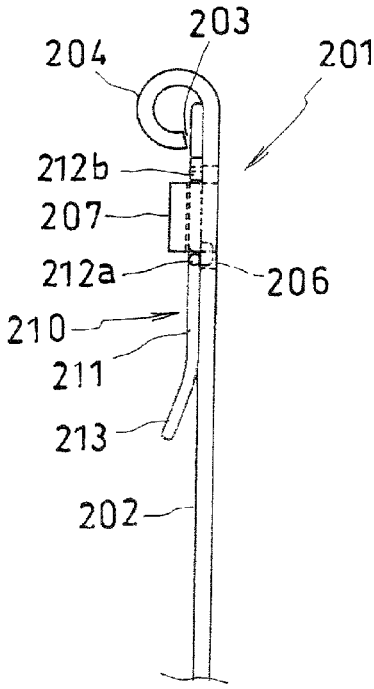
Figure 8:
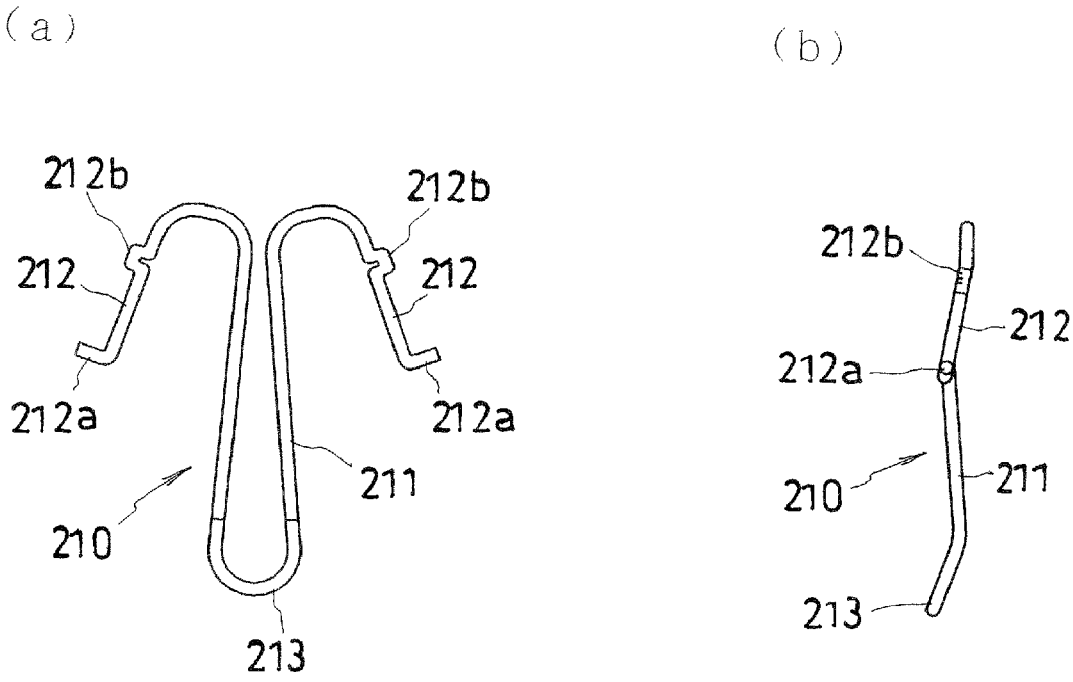
FIG. 8 is a front view (a) and a side view (b) of the metallic filament end retaining clip according to the third embodiment of the present invention.
Figure 9:
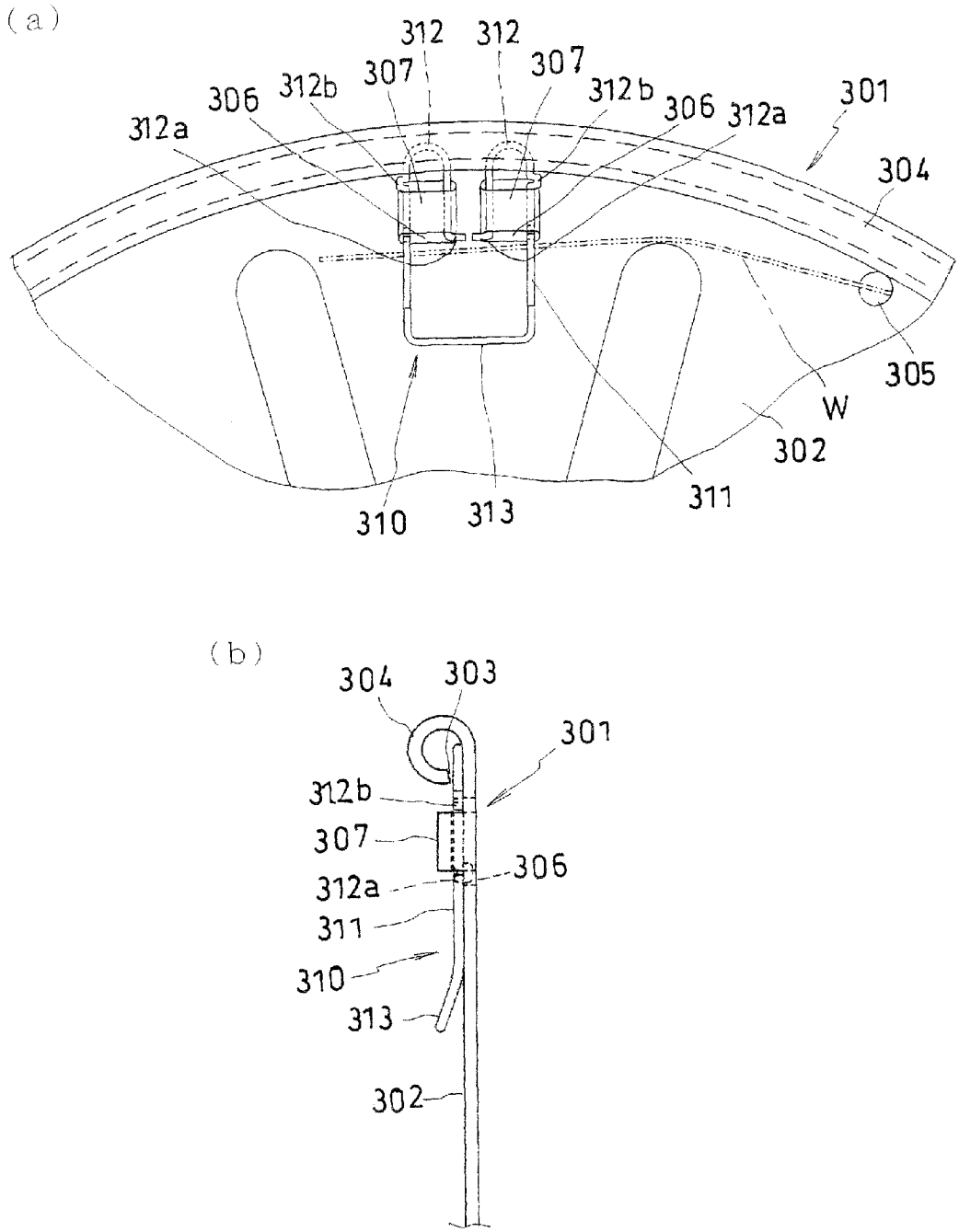
FIG. 9 is a front view (a) and a cross-sectional view (b) of the vicinity of a flange outer periphery portion in a reel for metallic filament in which a metallic filament end retaining clip has been mounted, according to a fourth embodiment of the present invention.
Figure 10:
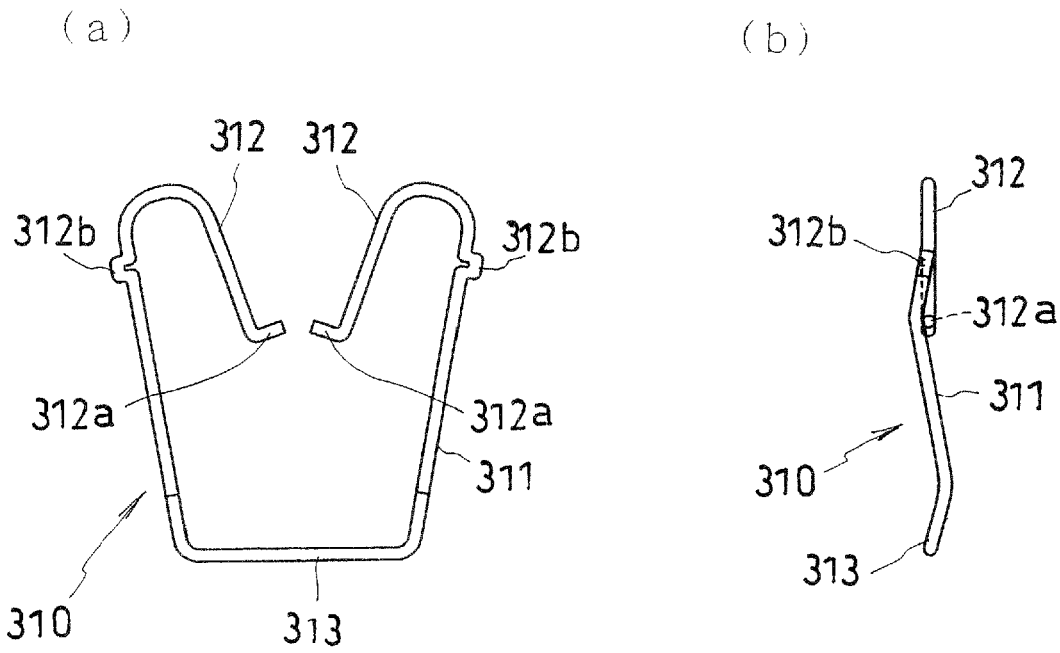
FIG. 10 is a front view (a) and a side view (b) of the metallic filament end retaining clip according to the fourth embodiment of the present invention.
Figure 11:
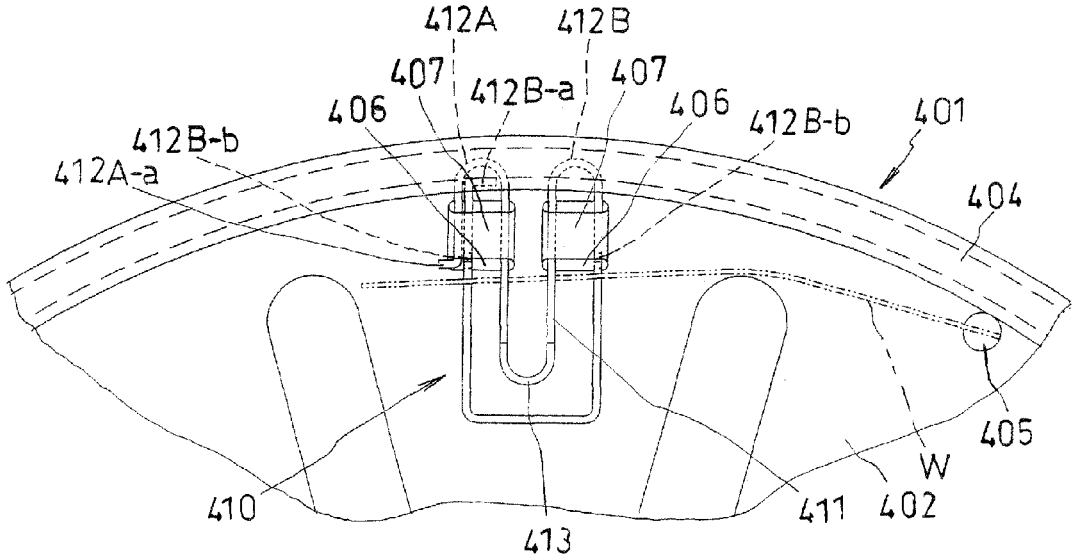
FIG. 11 is a front view (a) and a cross-sectional view (b) of the vicinity of a flange outer periphery portion in a reel for metallic filament in which a metallic filament end retaining clip has been mounted, according to a fifth embodiment of the present invention.
Figure 11:
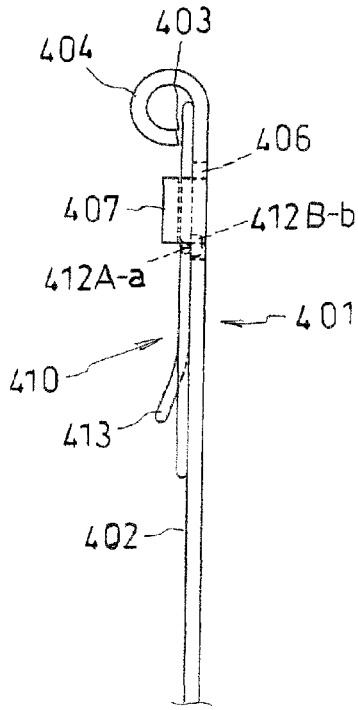
Figure 12:
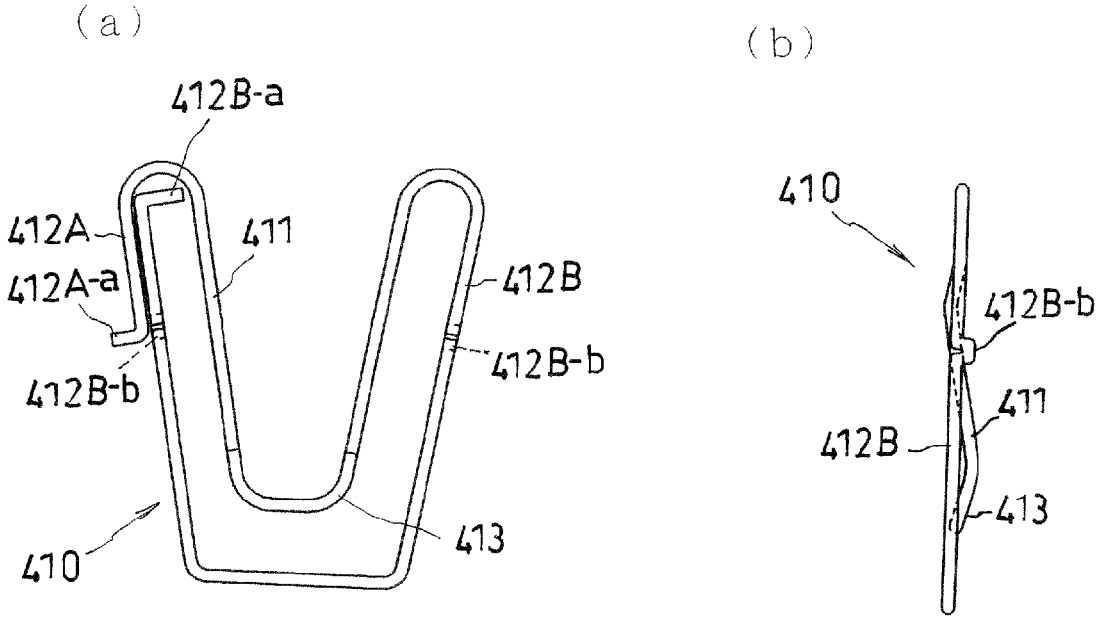
FIG. 12 is a front view (a) and a side view (b) of the metallic filament end retaining clip according to the fifth embodiment of the present invention.
Figure 13:
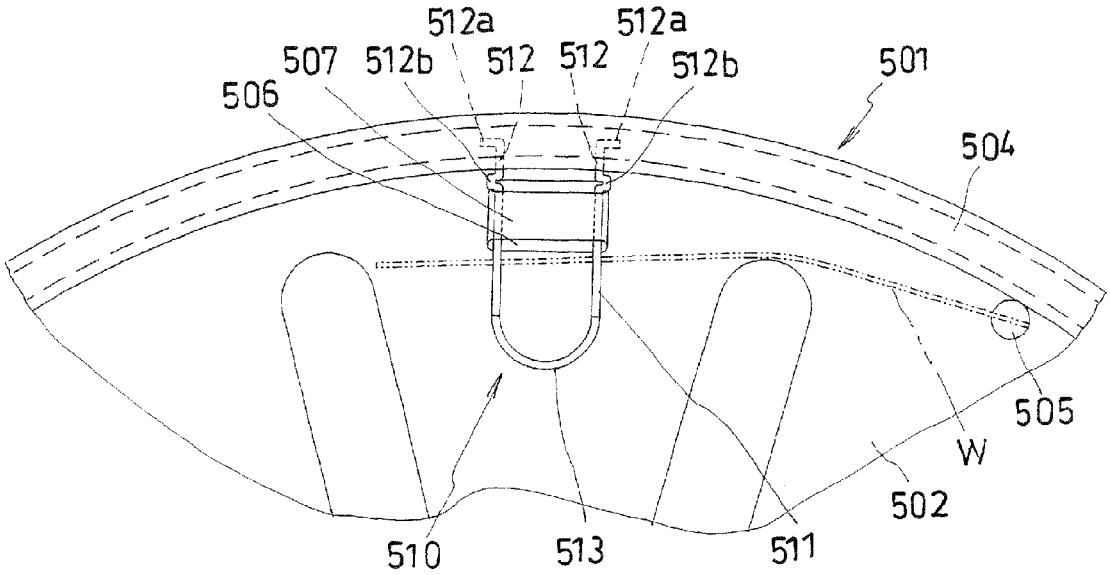
FIG. 13 is a front view (a) and a cross-sectional view (b) of the vicinity of a flange outer periphery portion in a reel for metallic filament in which a metallic filament end retaining clip has been mounted, according to a sixth embodiment of the present invention.
Figure 13:
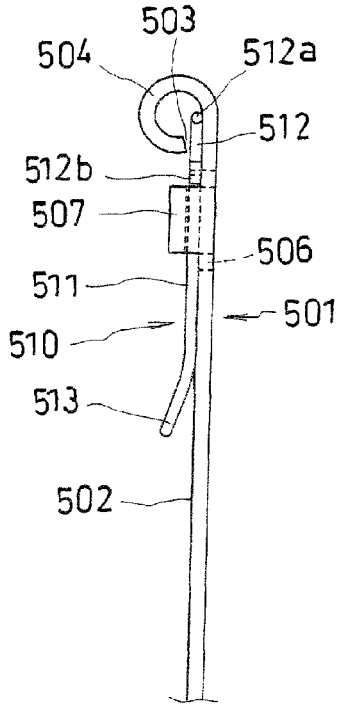
Figure 14:
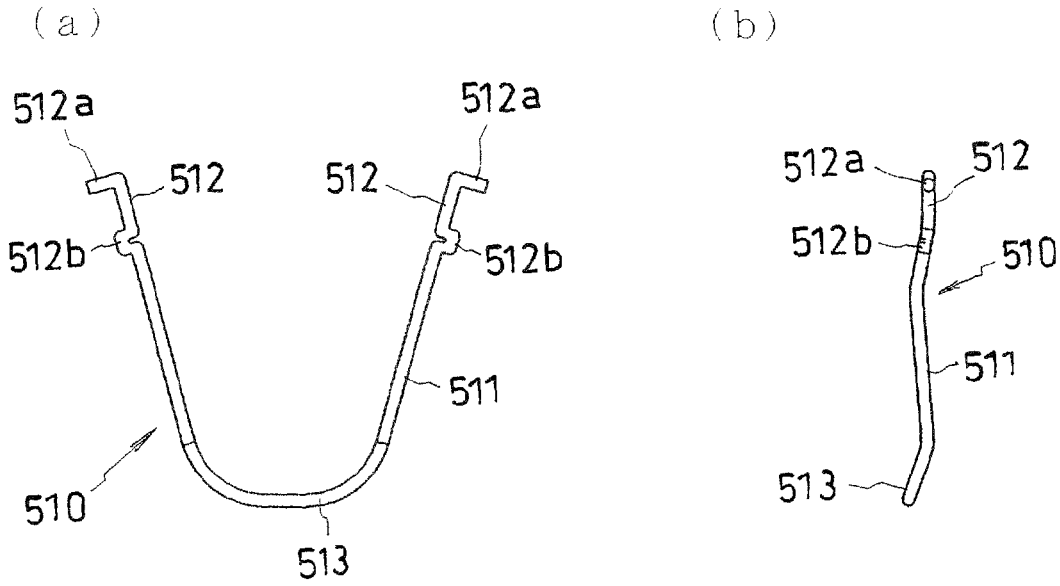
FIG. 14 is a front view (a) and a side view (b) of the metallic filament end retaining clip according to the sixth embodiment of the present invention.
Figure 15:
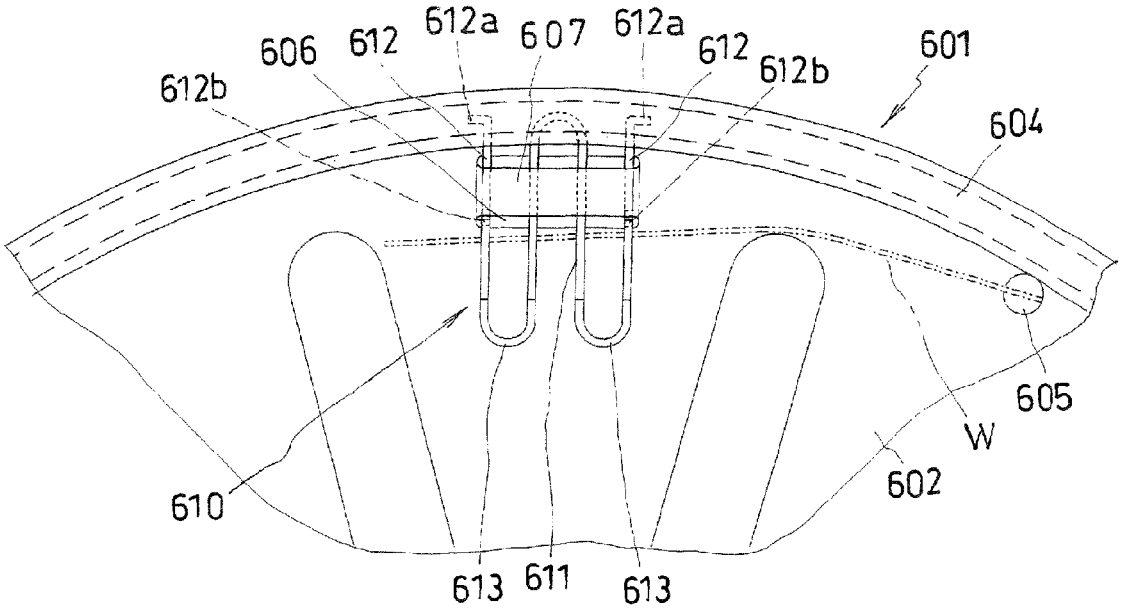
FIG. 15 is a front view (a) and a cross-sectional view (b) of the vicinity of a flange outer periphery portion in a reel for metallic filament in which a metallic filament end retaining clip has been mounted, according to a seventh embodiment of the present invention.
Figure 15:
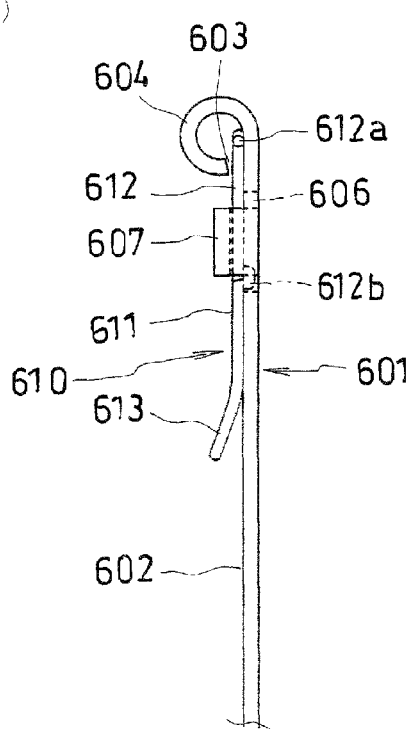
Figure 16:
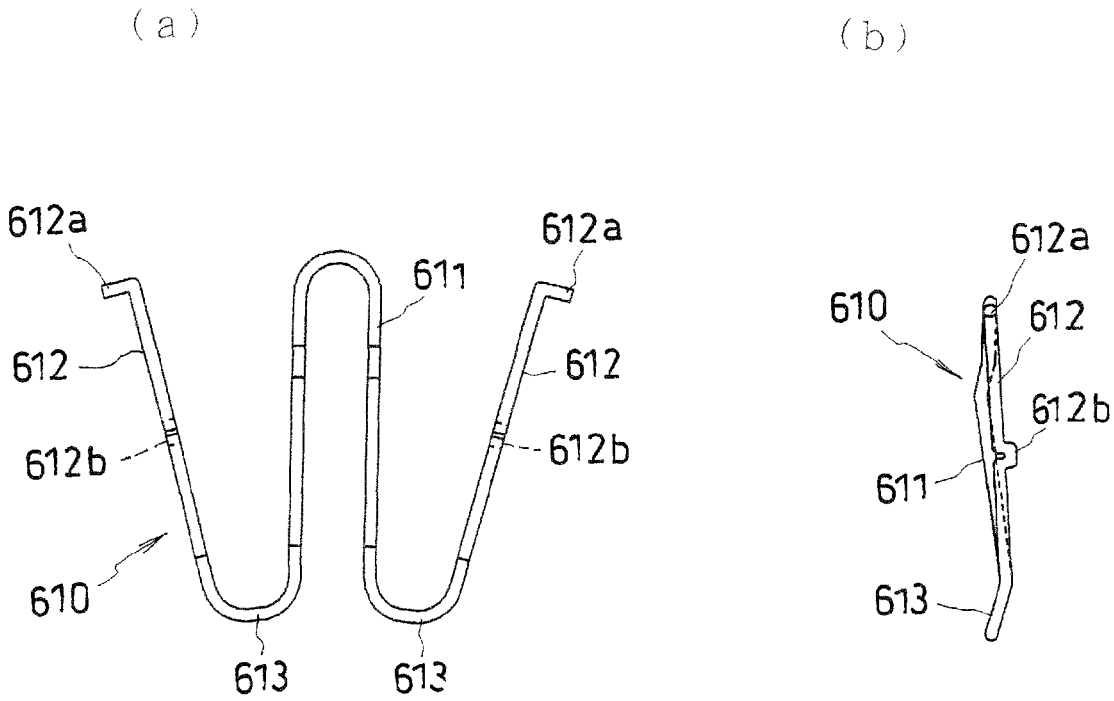
FIG. 16 is a front view (a) and a side view (b) of the metallic filament end retaining clip according to the seventh embodiment of the present invention.
Figure 17:
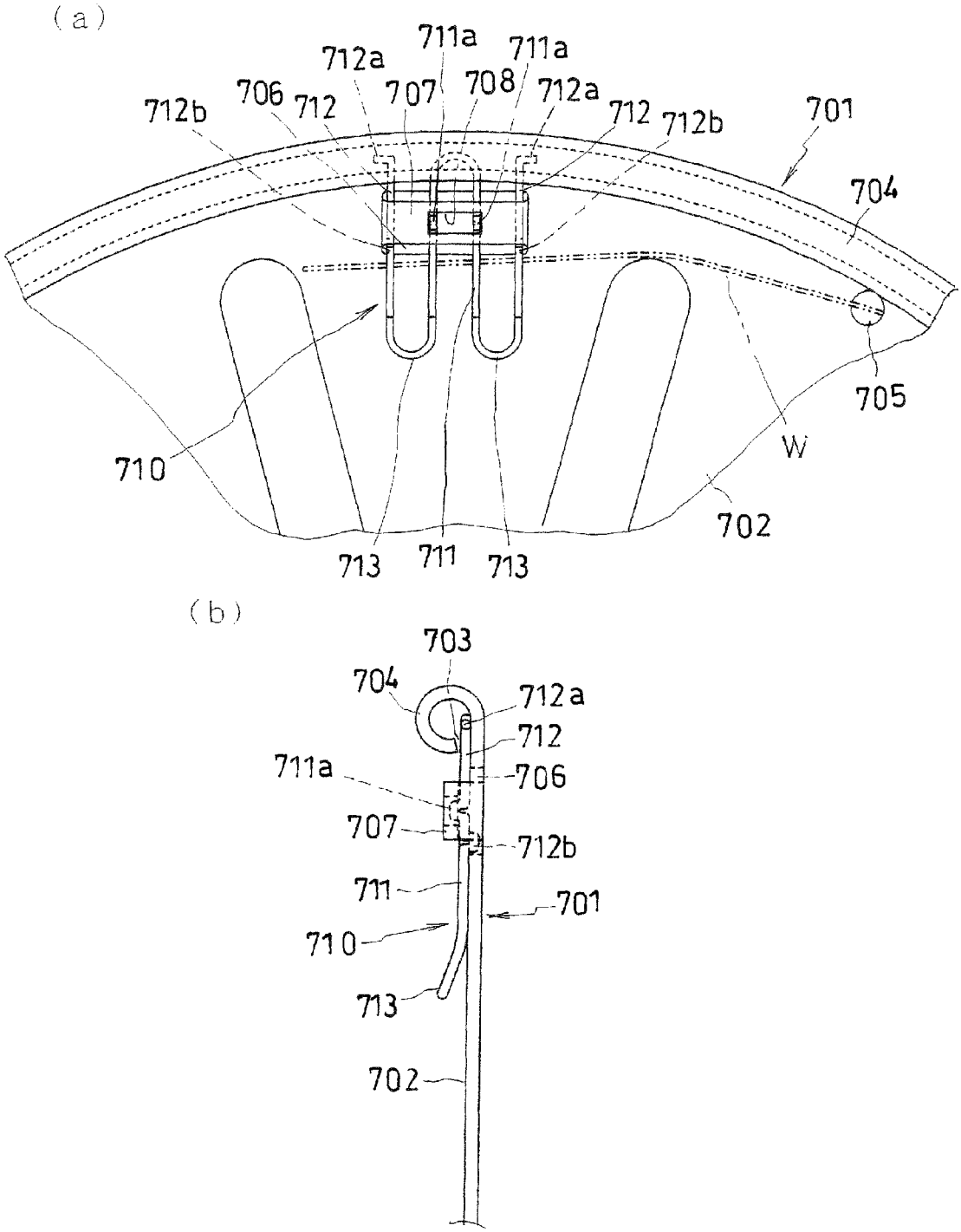
FIG. 17 is a front view (a) and a cross-sectional view (b) of the vicinity of a flange outer periphery portion in a reel for metallic filament in which a metallic filament end retaining clip has been mounted, according to an eighth embodiment of the present invention.
Figure 18:
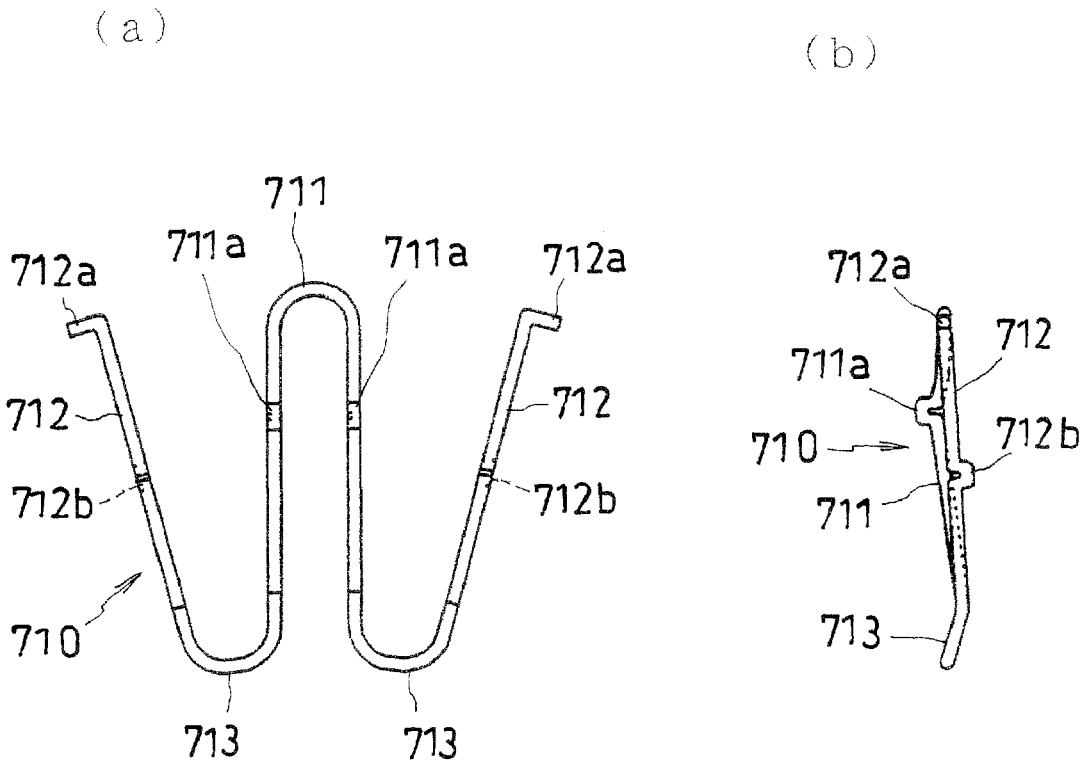
FIG. 18 is a front view (a) and a side view (b) of the metallic filament end retaining clip according to the eighth embodiment of the present invention.

1 flange
2 flange outer surface
3 space
4 flange outer periphery portion
5 passage hole
10, 20 metallic filament end retaining clip
11, 21 clip portion
12, 22 attachment arm portion
13, 23 guide portion
14, 24 coiled portion
α first angle
β second angle
101, 201, 301, 401, 501, 601, 701 flange
102, 202, 302, 402, 502, 602, 702 flange outer surface
103, 203, 303, 404, 504, 604, 704 space
104, 204, 304, 404, 504, 604, 704 flange outer periphery portion
105, 205, 305, 405, 505, 605, 705 passage hole
106, 206, 306, 406, 506, 606, 706 clip mounting hole
107, 207, 307, 407, 507, 607, 707 clip mounting portion
108 clip tip retaining hole
109 clip tip retaining portion
110, 210, 310, 410, 510, 610, 710 metallic filament end retaining clip
111, 211, 311, 411, 511, 611, 711 clip portion
112, 212, 312, 412A, 412B, 512, 612, 712 positioning attachment portion
112*a*, 212*a*, 312*a*, 412A-a, 412B-a, 512*a*, 612*a*, 712*a* tip stopper
113, 213, 313, 413, 513, 613, 713 guide portion
212*b*, 312*b*, 412B-b, 412B-b, 512*b*, 612*b*, 712*b* bent stopper

The invention claimed is:

1. A metallic filament end retaining clip mountable on a take-up reel for metallic filament provided with a flange made of a metallic plate on both sides of a winding drum that has a hollow ring-shaped flange outer periphery portion curling outward in the axial direction of the reel across the entire circumference of an outer edge, forming a space between the flange outer periphery portion and a flange outer surface, the metallic filament end retaining clip being mountable in a removable state in the space between the flange outer periphery portion and the flange outer surface, wherein a clip portion, formed from an elastic wire, is bent in an essentially W shape when viewed from the front, and attachment arm portions that extend the upper ends of the W shape in an essentially horizontal direction are formed on both sides of the clip portion;

guide portions for capturing the end part of the metallic filament are configured by slanting the vicinity of lower curved portions on both sides of the clip portion forward, as viewed from the side, at a first angle relative to the upper portion and middle portion of a part that forms an inverse V when the center of the clip portion is viewed from the front;

the upper portion of the clip portion, excluding the guide portions, of the outer wire portions of essentially V shapes on either side when viewed from the front, is, in its free state, slanted forward at a second angle relative to the guide portions when viewed from the side, the second angle being greater than the first angle, and coiled portions are formed in the vicinity of the upper ends of the outer wire portions;

the attachment arm portions are, in their free states, angled forward relative to a line that connects the upper ends of the W shape of the clip portion, and the tip sides of the attachment arm portions are bent even further forward; and the top bent portions in the center of the clip portion are positioned higher than the line that connects the upper ends of the W shape of the clip portion.

2. A take-up reel for metallic filament provided with a flange made of a metallic plate on both sides of a winding drum that has a hollow ring-shaped flange outer periphery portion curling outward in the axial direction of the reel across the entire circumference of an outer edge, forming a space between the flange outer periphery portion and a flange outer surface, the flange including a passage hole for passing the end part of the metallic filament into the flange, and a metallic filament end retaining clip being mounted in a removable state in the space between the flange outer periphery portion and the flange outer surface, wherein the metallic filament end retaining clip is configured so that a clip portion, formed from an elastic wire, is bent in an essentially W shape when viewed from the front, and attachment arm portions that extend the upper ends of the W shape in an essentially horizontal direction are formed on both sides of the clip portion;

guide portions are configured by slanting the vicinity of lower curved portions on both sides of the clip portion forward at a first angle relative to the top portion and middle portion of a part that forms an inverse V when the center of the clip portion is viewed from the front;

the upper portion of the clip portion, excluding the guide portions, of the outer wire portions of essentially V shapes on either side when viewed from the front, is, in its free state, slanted forward at a second angle relative to the guide portions when viewed from the side, the second angle being greater than the first angle, and coiled portions are formed in the vicinity of the upper ends of the outer wire portions;

the attachment arm portions are, in their free states, angled forward relative to a line that connects the upper ends of the W shape of the clip portion, and the tip sides of the attachment arm portions are bent even further forward; and the top bent portions in the center of the clip portion are positioned higher than the line that connects the upper ends of the W shape of the clip portion, and the top bent portion in the center of the clip portion of the metallic filament end retaining clip can be inserted into the space between the flange outer periphery portion and the flange outer surface and the attachment arm portions on both sides can be fitted into the space in a detachable state, the metallic filament end retaining clip is positioned on the flange outer surface, making contact therewith, and by inserting the top bent portion in the center of the clip portion into the space between the flange outer periphery portion and the flange outer surface and fitting the attachment arm portions into the interior of the flange outer periphery portion, the part that essentially forms an inverse V shape in the center of the clip portion is pressed upon the flange outer surface due to the elastic force of the deformed and fitted attachment arm portions, and the outer wire portions that essentially form V shapes on both sides of the clip portion are deformed and pressed down on the flange outer surface side so as to essentially overlap, when viewed from the side, with the part in the center of the clip portion that is essentially inverse V-shaped, the parts that are essentially inverse V-shaped press down upon the flange outer surface due to the elastic force of the outer wire portions caused by the deformation of the clip portion and the elastic force of the coiled portions, and thereby the end part of the metallic filament that has been passed through the passage hole and drawn along the guide portions is retained between the clip portion and the flange outer surface.

* * * * *